US006865364B2

(12) United States Patent
Matsumoto

(10) Patent No.: US 6,865,364 B2
(45) Date of Patent: Mar. 8, 2005

(54) FIXING DEVICE AND IMAGE FORMING APPARATUS

(75) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/456,125

(22) Filed: Jun. 6, 2003

(65) Prior Publication Data

US 2004/0190958 A1 Sep. 30, 2004

(30) Foreign Application Priority Data

Mar. 24, 2003 (JP) ..... 2003-079487

(51) Int. Cl.[7] ..... G03G 15/20
(52) U.S. Cl. ..... 399/329; 219/216; 399/67
(58) Field of Search ..... 399/69, 70, 67, 399/21, 320, 328, 329; 219/216, 388, 243, 254

(56) References Cited

U.S. PATENT DOCUMENTS 6,088,558 A * 7/2000 Yamada et al. ..... 399/329 X
6,282,398 B1 * 8/2001 Higashi ..... 399/329
6,580,894 B1 * 6/2003 Kobashigawa ..... 399/329
6,725,009 B1 * 4/2004 Tatematsu et al. ..... 399/329
2001/0003562 A1 * 6/2001 Hachisuka et al. ..... 399/329
2003/0185604 A1 * 10/2003 Sato ..... 399/329

FOREIGN PATENT DOCUMENTS

JP 07-036306 A 2/1995
JP 2001-194946 A 7/2001
JP 2001-249569 A 9/2001

* cited by examiner

*Primary Examiner*—Sophia S. Chen
(74) *Attorney, Agent, or Firm*—Akin Gump Strauss Hauer & Feld, LLP

(57) ABSTRACT

A fixing device (1) includes a fixing roller (11), a heating roller (12), an endless belt (13) stretched around the fixing roller (11) and the heating roller (12), and a pressure roller (14) facing the fixing roller (11) via the endless belt (13), and has an internal heat source. The endless belt (13) is applied the tension by means of a tension applying spring (17). The fixing roller (11) is supported by a swing lever (15) and pressed against the pressure roller (14). The swing lever (15) is pushed by a cam (18) upward, so that the fixing roller (11) shifts in the direction away from the pressure roller (14). As the fixing roller (11) shifts upward, the tension applied to the endless belt (13) decreases.

31 Claims, 30 Drawing Sheets

FIXING DEVICE AND IMAGE FORMING APPARATUS

BACKGROUND OF THE INVENTION

This invention relates to a fixing device for fixing a toner image to a recording sheet in a printer or the like, and relates to an image forming apparatus having the fixing device.

A fixing device is used to fix a toner image to a recording sheet in an image forming apparatus such as a printer. There is a type of fixing device having an endless belt as disclosed in Laid-Open Patent Publication Nos. 2001-249569 (Page 5, FIG. 1), 2001-194946 (Pages 6–7, FIG. 1) and HEI 7-36306 (Page 4, FIG. 4). Such a fixing device is called a belt-type fixing device.

The belt-type fixing device includes a fixing roller such as a rubber covered roller, a heating roller having an internal heat source, and an endless belt stretched around the fixing roller and the heating roller. A pressure roller faces the fixing roller via the endless belt. The pressure roller is pressed against the fixing roller via the endless belt, so that a nip portion is formed between the pressure roller and the endless belt.

In the belt-type fixing device, if the endless belt is pressed by the fixing roller and the pressure roller for a long time, an impression may be formed on the endless belt by the fixing roller or the pressure roller. Such an impression may shorten the lifetime of the endless belt. Moreover, such an impression may cause a so-called offset phenomenon that a part of the toner image is not fixed to the recording sheet, and may cause a fluctuation of the running speed of the endless belt, which may result in non-uniformity of the fixed image. Furthermore, an impression (a so-called nip mark) may be formed on the fixing roller or the pressure roller by the nip pressure. Such an impression may be transferred to the endless belt, and may shorten the lifetime of the endless belt. In order to solve these problems, Japanese Laid-Open Patent Publication No. 2001-249569 discloses a fixing device in which the fixing roller is able to separate from the fixing roller.

However, in the conventional fixing device, the pressure roller has no heat source and is heated by the indirect heat transmitted through the endless belt. Therefore, it is necessary to heat the endless belt and the rollers (i.e., the fixing roller, the heating roller and the pressure roller) while the endless belt is pressed by the fixing roller and the pressure roller. In order to uniformly heat the endless belt and the rollers, it is preferable to move the endless belt during the heating operation. However, if the endless belt moves while the endless belt is pressed by the fixing roller and the pressure roller, the endless belt may be damaged by a solidified toner that remains on the endless belt or the pressure roller. Thus, it is not possible to start moving the endless belt until the solidified toner is molten. Therefore, it takes a long time to uniformly heat the endless belt and the rollers.

In addition, the temperatures of the endless belt and the rollers affect one another, and therefore the controlling of the temperatures of the endless belt and the rollers is complicated. As a result, it takes a long time for the endless belt and the rollers to reach the predetermined temperatures.

SUMMARY OF THE INVENTION

An object of the present invention is to provide a fixing device and an image forming apparatus capable of lengthening the lifetimes of an endless belt and rollers, reducing the non-uniformity of a fixed image, and enabling a rapid controlling of the endless belt and the rollers.

According to the invention, there is provided a fixing device including a group of rollers including at least one roller having a heat source and a first roller having no heat source. An endless belt is stretched around the group of rollers. A second roller faces the first roller via the endless belt so as to form a nip portion between the second roller and the endless belt. The second roller has a heat source. The fixing device further includes a shifting mechanism that shifts the first roller in the direction away from the second roller.

With such an arrangement, it is possible to shift the first roller and the endless belt away from the second roller, except when the image is fixed to a recording sheet. Therefore, it is possible to prevent the endless belt from being pressed by the first and second rollers for a long time, so that an impression is not formed on the endless belt. As a result, the lifetime of the endless belt can be lengthened, and the non-uniformity of the fixing image can be reduced. Further, as the second roller has the heat source, it is possible to heat the endless belt and the rollers while the first roller and the endless belt are apart from the second roller. Thus, the heat transmission between the first roller and the second roller can be restricted. Moreover, the temperatures of the endless belt and the rollers can be controlled while the endless belt is moved, with the result that rapid and efficient temperature control can be accomplished.

DETAILED DESCRIPTION OF THE INVENTION

Embodiments of the present invention will be described with reference to the attached drawings.

Embodiment 1

Figure 1:
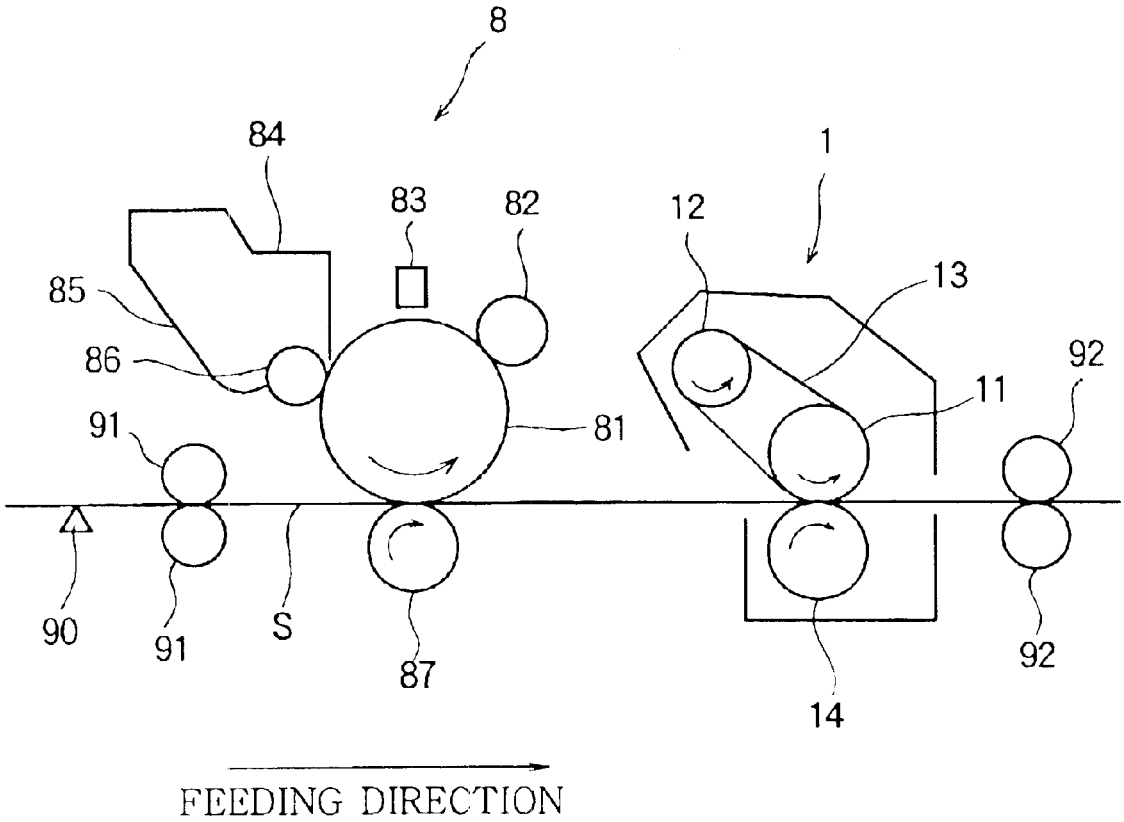
FIG. 1 is a side view of an image forming apparatus using a fixing device according to Embodiment 1 of the present invention.

FIG. 1 is a side view illustrating the basic configuration of an image forming apparatus having a fixing device 1 according to Embodiment 1 of the present invention. The image forming apparatus uses an electrophotographic technology, and includes an image forming unit 8 that forms a toner image on a recording sheet S and a fixing device 1 that fixes the toner image (formed by the image forming unit 8) to the recording sheet S. In FIG. 1, the recording sheet S is fed from the left to the right.

The image forming unit 8 includes a photoconductive drum 81 for carrying a latent image. Around the circumference of the photoconductive drum 81, a charging roller 82, an exposing device 83 and a developing device 84 are disposed in this order in the direction of the rotation (counterclockwise in FIG. 1) of the photoconductive drum 81. A transfer roller 87 is disposed at the lower side of the photoconductive drum 81 so that the recording sheet S is pinched by the photoconductive drum 81 and the transfer roller 87. The charging roller 82 uniformly charges the surface of the photoconductive drum 81. The exposing device 83 exposes a photoconductive layer of the photoconductive drum 81 according to an image data, and forms the latent image. The developing device 84 supplies the toner stored in a toner container 85 to the photoconductive drum 81 by means of a developing roller 86. The toner adheres to the surface of the photoconductive drum 81 and develops the latent image, so as to form the toner image. The transfer roller 87 is applied a bias voltage and transfers the toner image from the photoconductive drum 81 to the recording sheet S.

The recording sheet S is fed by a pair of rollers 91 disposed in the upstream side of the image forming unit 8, another pair of rollers 92 disposed in the downstream side of the image forming unit 8, and the transfer roller 87 of the image forming unit 8 and the like.

Figure 2:
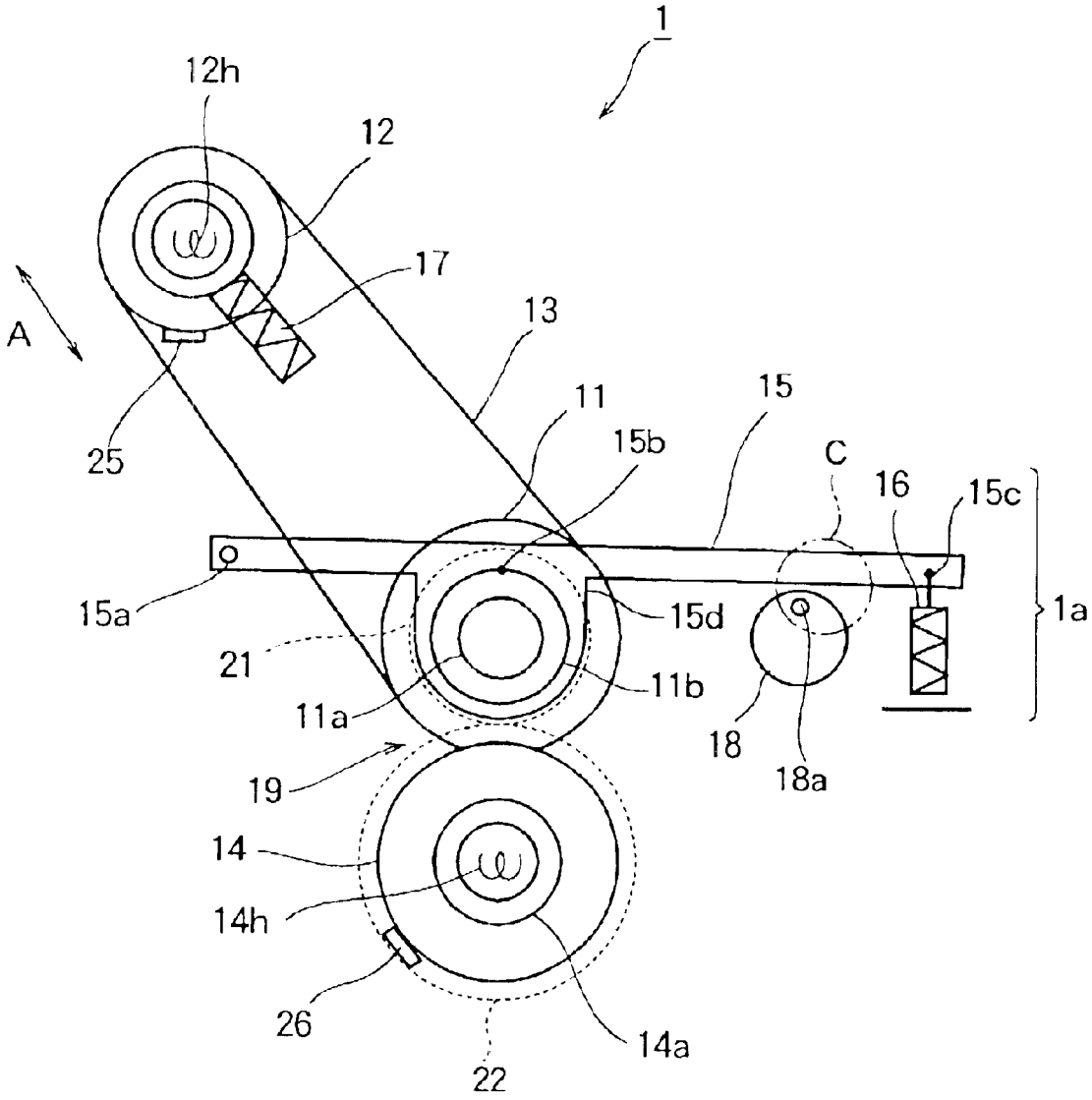
FIG. 2 is a side view of the fixing device according to Embodiment 1 of the present invention.
Figure 3:
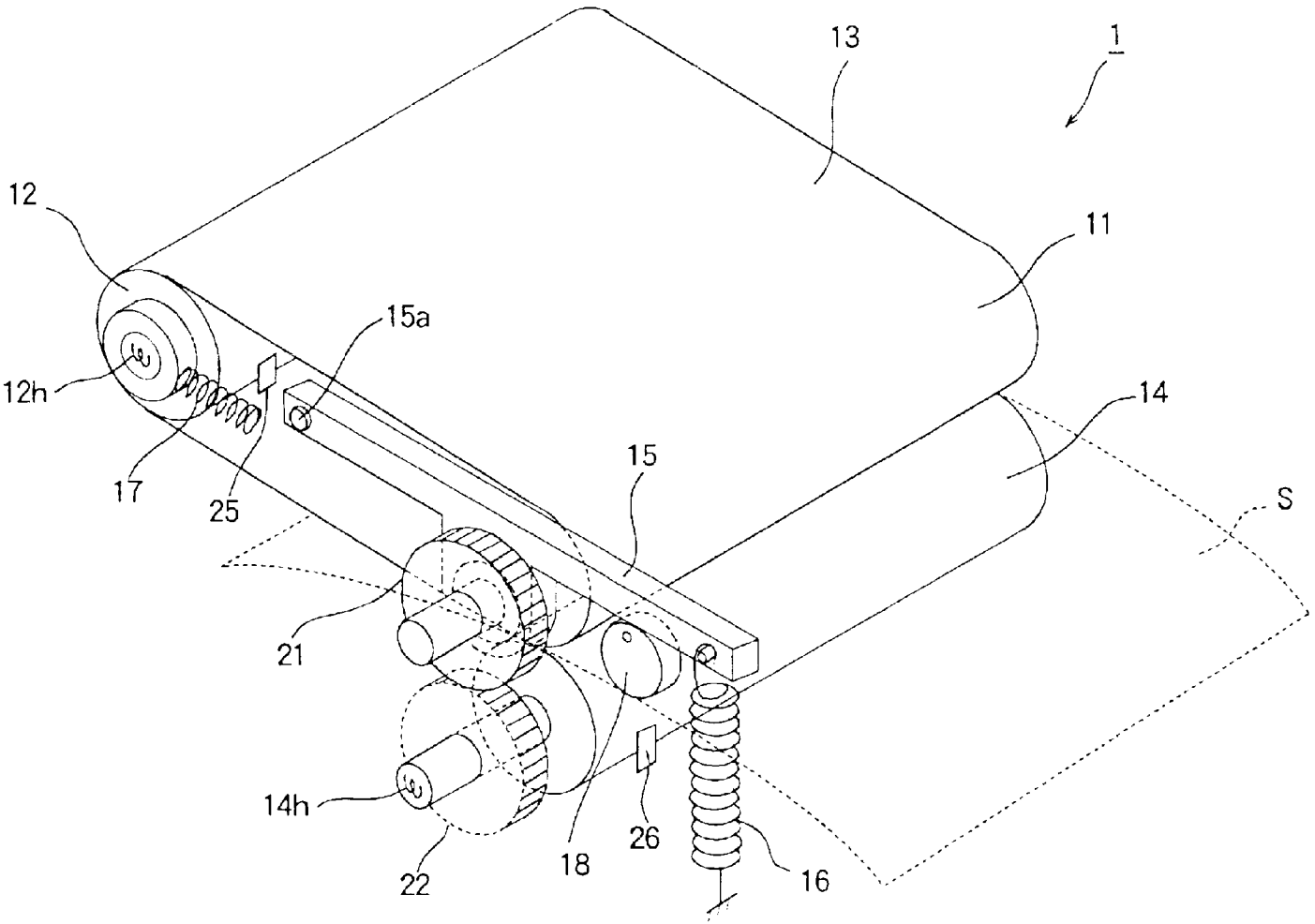
FIG. 3 is a perspective view of the fixing device according to Embodiment 1 of the present invention.

FIGS. 2 and 3 are a side view and a perspective view of the fixing device 1 of Embodiment 1. The fixing device 1 includes a fixing roller (a first roller) 11, a heating roller 12, an endless belt 13 stretched around the fixing roller 11 and the heating roller 12, and a pressure roller (a second roller) 14 that faces the fixing roller 11 via the endless belt 13.

The pressure roller 14 has a halogen lamp 14*h* as an internal heat source. The pressure roller 14 has a main shaft 14*a* rotatably supported by not shown bearings. A gear 22 is fixed to the main shaft 14*a*, and connected to a roller drive motor 23 (FIG. 9) via a not shown power transmission mechanism. The outer layer of the pressure roller 14 has a higher hardness than the outer layer of the fixing roller 11.

The fixing roller 11 extends in parallel with the pressure roller 14, and is located at the upper side of the pressure roller 14. The outer layer of the fixing roller 11 is made of a resilient material such as a rubber. The fixing roller 11 has a main shaft 11*a* to which a gear 21 is fixed. The gear 21 is able to engage the above described gear 22 of the pressure roller 14. The main shaft 11*a* of the fixing roller 11 is supported by a swing lever (a roller supporting member) 15 via a bearing 11*b*. The swing lever 15 is disposed substantially above the pressure roller 14. The swing lever 15 extends in the substantially horizontal direction and perpendicular to the axis of the fixing roller 11. The swing lever 15 is swingable upward and downward about a fulcrum 15*a* provided at a longitudinal end (i.e., the left end in FIG. 2) of the swing lever 15. The other end (i.e., the right end in FIG. 2) of the swing lever 15 is urged downward by means of a lever urging spring 16 in the form of a tension spring. The point where the lever urging spring 16 acts on the swing lever 15 is referred to as a spring action point 15*c*. The swing lever 15 has a bearing 11*b* on the substantial center portion in the longitudinal direction thereof. The bearing 11*b* supports the main shaft 11*a* of the fixing roller 11.

A cam 18 for driving the swing lever 15 is disposed under the swing lever 15 and between the fixing roller 11 and the lever urging spring 16. The cam 18 is substantially in the form of a disk, and has a rotation shaft 18*a* shifted from the center of the disk. When the cam 18 is in a state indicated by a solid line in FIG. 2, the circumferential end surface of the cam 18 does not abut against the swing lever 15. When the cam 18 rotates as indicated by a dashed line C in FIG. 2, the circumferential end surface of the cam 18 abuts against the swing lever 15, and pushes the swing lever 15 upward. The swing lever 15 and the cam 18 constitute a shifting mechanism 1*a* that shifts the fixing roller 11 in the direction away from the pressure roller 14.

Figure 4:
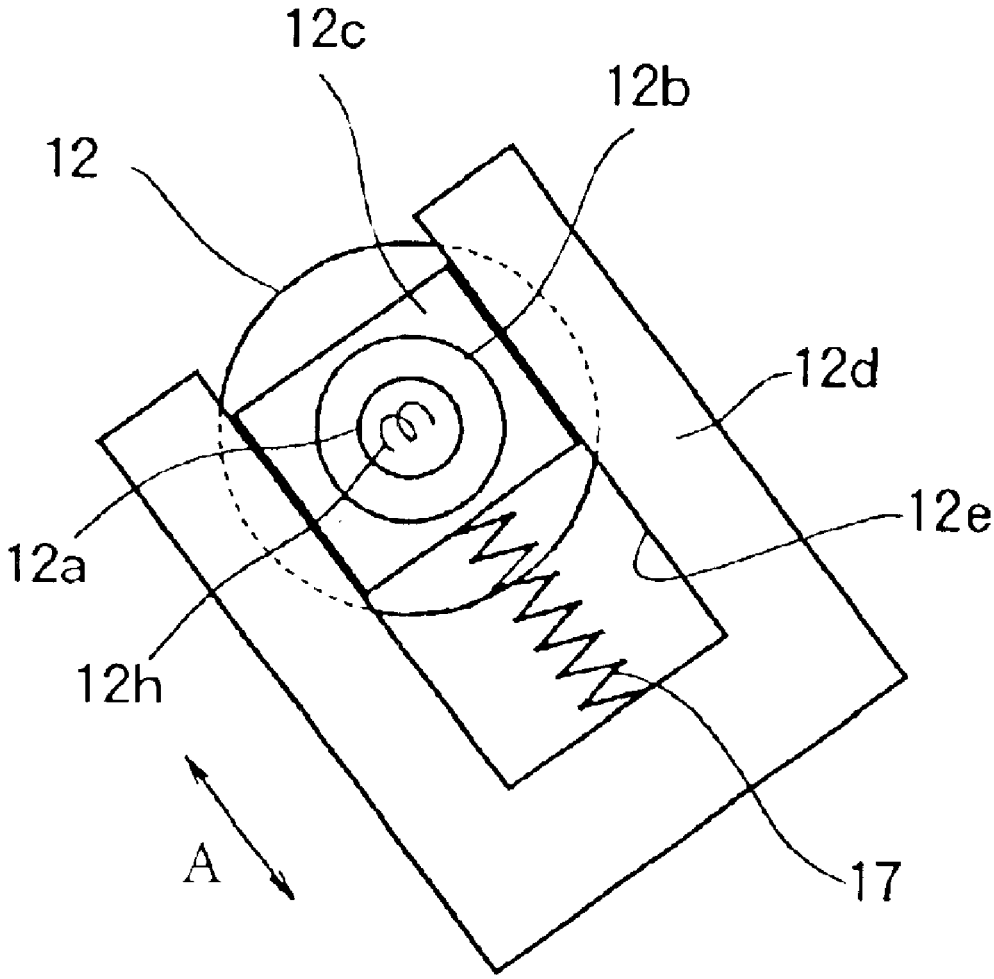
FIG. 4 is a side view illustrating a structure for supporting a heating roller of the fixing device according to Embodiment 1 of the present invention.

The heating roller 12 has a halogen lamp 12*h* as an internal heat source. The heating roller 12 extends in parallel with the fixing roller 11, and is disposed above the upstream side of the fixing roller 11, i.e., the upper-left side of the fixing roller 11 in FIG. 2. The heating roller 12 is able to shift in the direction toward and away from the fixing roller 11, i.e., the direction indicated by an arrow A in FIG. 2. The heating roller 12 is urged in the direction away from the fixing roller 11, by means of a tension applying spring (a tension applying member) 17. FIG. 4 is a side view of a structure for supporting the heating roller 12. A main shaft 12*a* of the heating roller 12 is supported by a bearing 12*b* mounted to a support block 12*c*. The support block 12*c* is supported by a guide groove 12*e* formed on a guide member (a supporting mechanism) 12*d*, and is slidable along the guide groove 12*e* in the direction toward and away from the fixing roller 11. The tension applying spring 17 is in the form of a compression spring, and is disposed between a bottom of the guide groove 12*e* and the block 12*c*.

The endless belt 13 is stretched around the fixing roller 11 and the heating roller 12. The width of the endless belt 13 in the direction of the axis of the fixing roller 11 is greater than the width of the recording sheet S.

The opening and closing operation of the fixing roller 11 and the pressure roller 14 will be described. As shown in FIG. 2, when the circumferential end surface of the cam 18 does not abut against the swing lever 15, the swing lever 15 is urged downward by means of the lever urging spring 16. In this state, the fixing roller 11 is pressed against the pressure roller 14 via the endless belt 13, so that the endless belt 13 and the pressure roller 14 form a nip portion 19 in which the recording sheet is heated and pressed. The hardness of the outer layer of the fixing roller 11 is lower than that of the pressure roller 14, and therefore the fixing roller 11 deforms along the outer surface of the pressure roller 14. This means that the feeding path of the recording sheet is defined along the outer surface of the pressure roller 14. The uppermost point of the bearing 11*b* is defined as a roller action point 15*b* where the swing lever 15 acts on the bearing 11*b* of the fixing roller 11. The force by which the fixing roller 11 is pressed against the pressure roller 14 is determined by the ratio of the distance between the fulcrum 15*a* and the spring action point 15*c* to the distance between the fulcrum 15*a* and the roller action point 15*b*, and also determined by the spring force of the lever urging spring 16.

Figure 5:
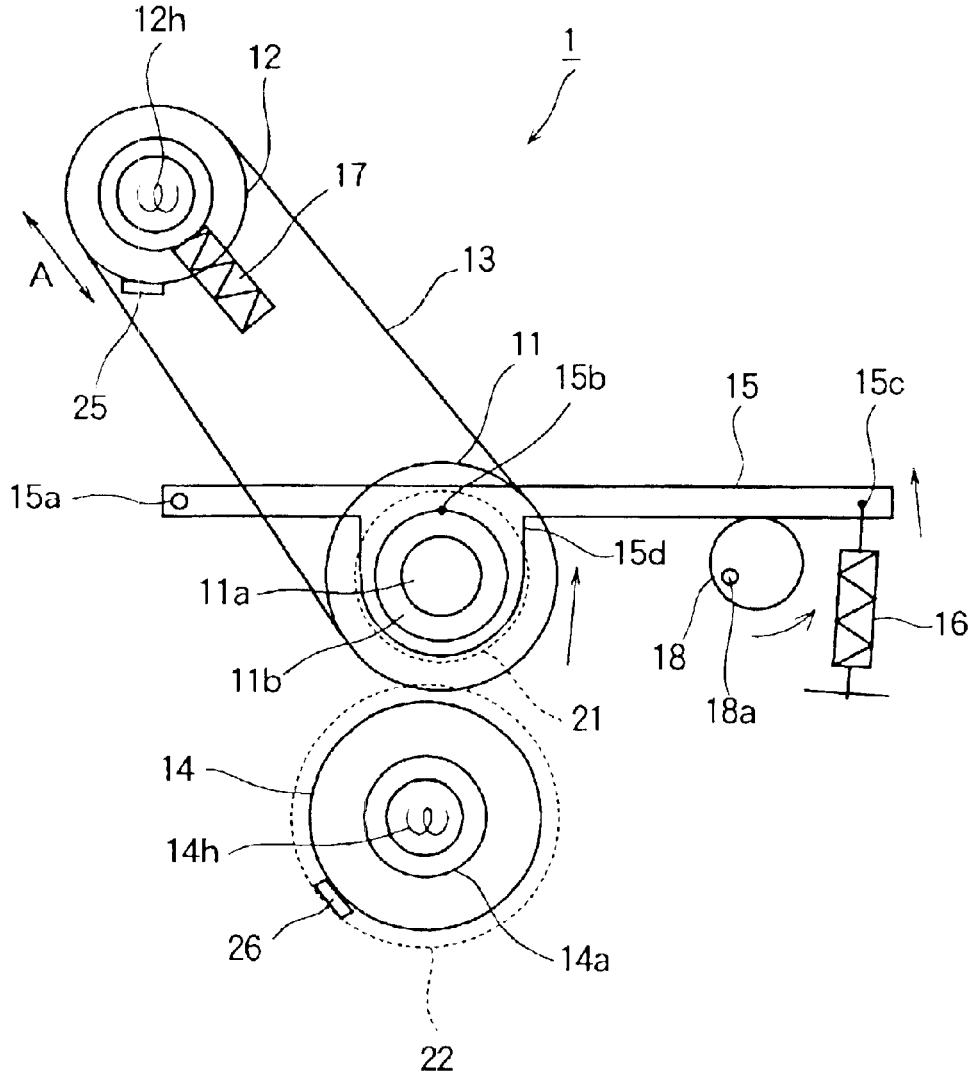
FIG. 5 is a side view illustrating an operation of the fixing device according to Embodiment 1 of the present invention.

FIG. 5 is a side view illustrating the state in which the cam 18 rotates a certain degree about the rotation shaft 18*a* and pushes the swing lever 15 upward. When the cam 18 pushes the swing lever 15 upward, overcoming the force of the lever urging spring 16, the fixing roller 11 shifts upward so that the fixing roller 11 and the endless belt 13 separate from the pressure roller 14 by a predetermined amount.

Figure 6A:
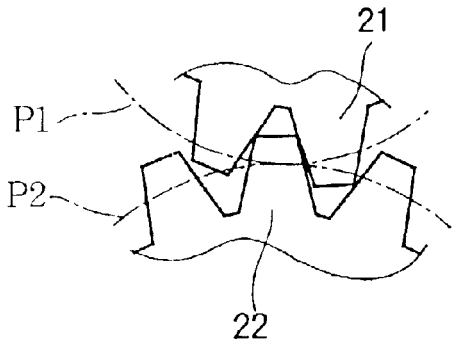
FIGS. 6A and 6B are enlarged views illustrating the engagement of gears of the fixing device according to Embodiment 1 of the present invention.
Figure 6B:
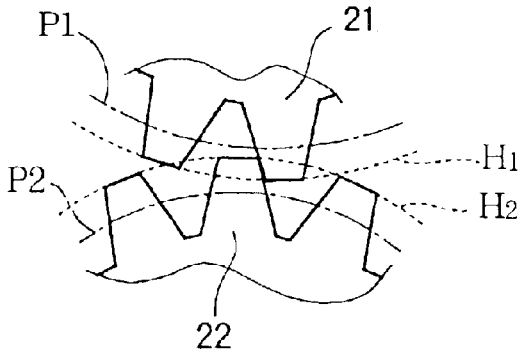

FIGS. 6A and 6B are enlarged views illustrating how the engagement of the gears 21 and 22 changes according to the shifting of the fixing roller 11. As shown in FIG. 6A, when the fixing roller 11 is pressed against the pressure roller 14 via the endless belt 13, the gear 21 of the fixing roller 11 and the gear 22 of the pressure roller 14 engage each other. In other word, pitch circles P1 and P2 of the gears 21 and 22 contact each other, so that the rotation of the pressure roller 14 is smoothly transmitted to the fixing roller 11.

In contrast, as shown in FIG. 6B, when the fixing roller 11 and the endless belt 13 separate from the pressure roller 14, the pitch circles P1 and P2 of the gears 21 and 22 separate from each other. However, addendum circles H1 and H2 of the gears 21 and 22 intersect each other. In other word, the gears 21 and 22 are in such relative positions that the tooth top portions of the gears 21 and 22 are able to contact each other, so that the gears 21 and 22 are able to transmit the rotation to each other. Therefore, even when the fixing roller 11 and the endless belt 13 separate from the pressure roller 14, the rotation of the pressure roller 14 can be transmitted to the fixing roller 11. Such an arrangement is accomplished, for example, when the module of each of the gears 21 and 22 is equal to 1 mm, and the distance between the fixing roller 11 and the pressure roller 14 is smaller than or equal to 1 mm.

Figure 7:
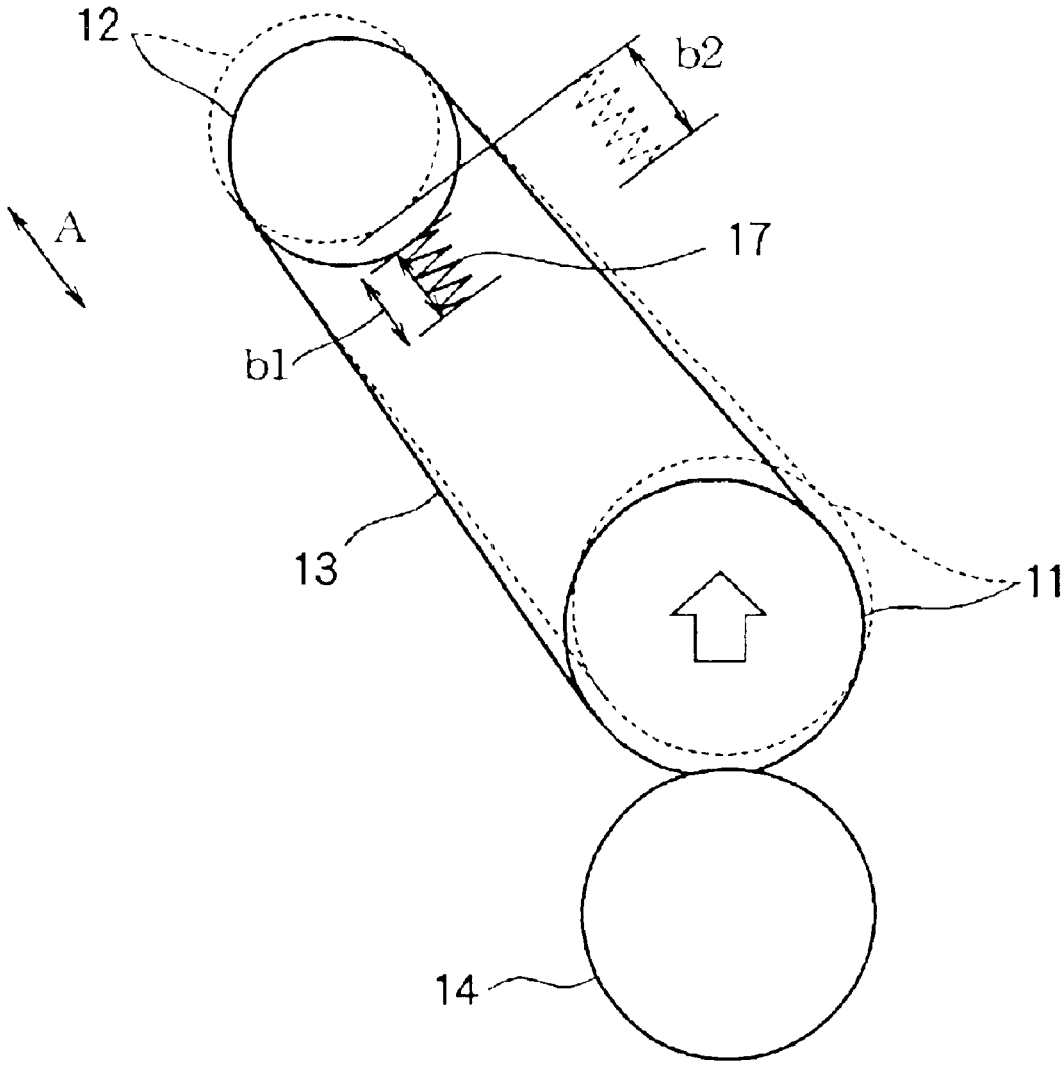
FIG. 7 is a schematic view illustrating the positional relationship among a fixing roller, a heating roller and an endless belt of the fixing device according to Embodiment 1 of the present invention.

FIG. 7 is a schematic view illustrating how the tension of the endless belt 13 changes according to the shifting of the fixing roller 11. As described above, the heating roller 12 is urged in the direction away from the fixing roller 11 by means of the tension applying spring 17 in the form of a compression spring. When the fixing roller 11 is pressed against the pressure roller 14 via the endless belt 13, the length of the tension applying spring 17 is referred to b1. When the cam 18 pushes the swing lever 15 upward and the fixing roller 11 shifts upward, the heating roller 12 shifts in the direction away from the fixing roller 11. In this state, the length b2 of the tension applying spring 17 is longer than the above described length b1, so that the tension applied to the endless belt 13 decreases.

Figure 8:
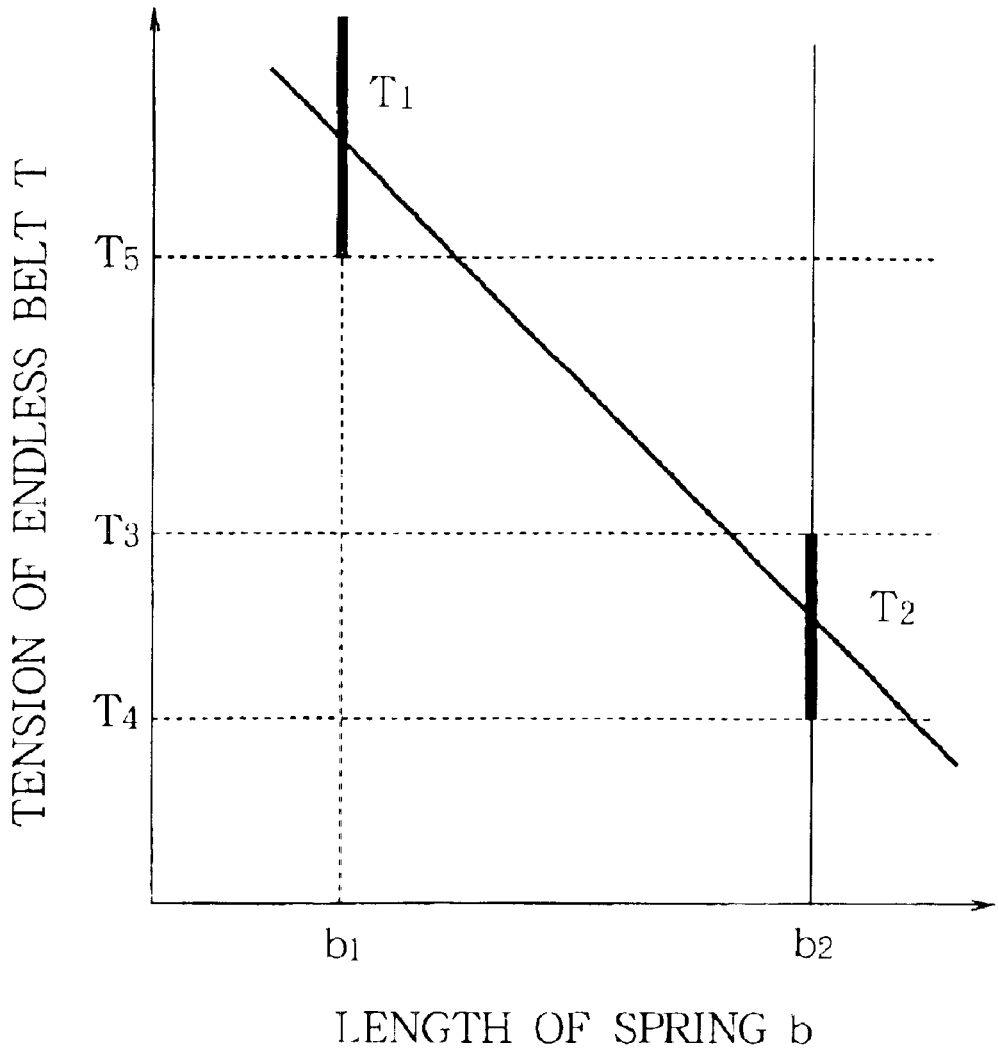
FIG. 8 is a graph illustrating the characteristics of a spring of the fixing device according to Embodiment 1 of the present invention.

FIG. 8 is a graph illustrating the relationship between the length b of the tension applying spring 17 and the tension T applied to the endless belt 13. In a state the fixing roller 11 and the endless belt 13 separate from the pressure roller 14 (i.e., the length of the tension applying spring 17 is b2), if the tension T of the endless belt 13 is too strong, an impression may be formed on the endless belt 13 after the endless belt 13 contacts the fixing roller 11 and the heating roller 12 for a long time. The tension T3 indicates an upper limit of the range in which the impression is not formed on the endless belt 13. In contrast, if the tension T of the endless belt 13 is too small, the endless belt 13 may slip over the fixing roller 11 and the heating roller 12 when the fixing roller 11 rotates. The tension T4 indicates a lower limit of the range in which the endless belt 13 does not slip over the fixing roller 11 and the heat roller 12. The tension applying spring 17 has a spring constant and dimensions so that the tension T2 applied to the endless belt 13 is smaller than or equal to the tension T3 and greater than or equal to the tension T4 (i.e., $T3 \geqq T2 \geqq T4$), when the length of the tension applying spring 17 is b2.

In a state the fixing roller 11 is pressed against the pressure roller 14 via the endless belt 13 (i.e., the length of the tension applying spring 17 is b1), if the tension T of the endless belt 13 is too small, the endless belt 13 may slip over the fixing roller 11 when the endless belt 13 moves together with the recording sheet in the nip portion 19. The tension T5 indicates a lower limit of the range in which the endless belt 13 does not slip over the fixing roller 11. The tension applying spring 17 has a spring constant and dimensions so that the tension Ti applied to the endless belt 13 is greater or equal to the tension T5 (i.e., T1≧T5), when the length of the tension applying spring 17 is b1.

Figure 9:
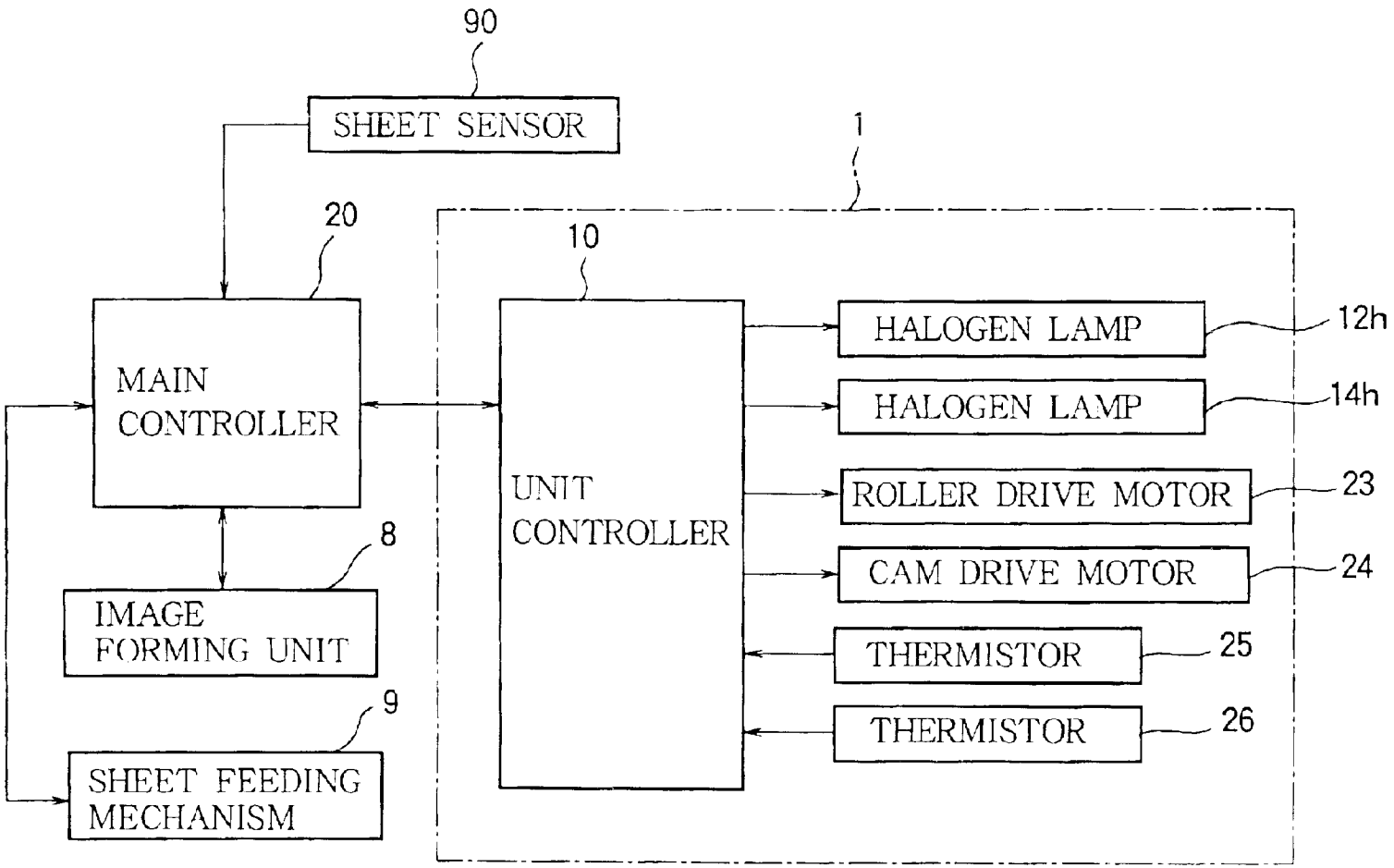
FIG. 9 is a block diagram illustrating a control system of the image forming apparatus including the fixing device according to Embodiment 1 of the present invention.

FIG. 9 is a block diagram illustrating the control system of the image forming apparatus including the fixing device 1. A unit controller 10 is provided for controlling the fixing device 1. The unit controller 10 drives the halogen lamp 12*h* in the heating roller 12, the halogen lamp 14*h* in the pressure roller 14, a roller drive motor 23 for rotating the pressure roller 14 and the cam drive motor 24 for rotating the cam 18. Further, the unit controller 10 receives the data of the surface temperature of the heating roller 12 and the pressure roller 14. The data is outputted from a thermistor 25 disposed in the vicinity of the heating roller 12 and a thermistor 26 disposed in the vicinity of the pressure roller 14. A main controller 20 is provided for controlling the image forming apparatus. The main controller 20 controls the unit controller 10, a sheet feeding mechanism 9 including the pairs of rollers 91 and 92 (FIG. 1), and the image forming unit 8. Further, the main controller 20 receives a detection signal from a sheet sensor 90. The detection signal indicates that the sheet sensor 90 detects the passage of the front end or the rear end of the recording sheet.

The operation of the image forming apparatus will be described. As shown in FIG. 5, in a standby state prior to the image fixing operation, the swing lever 15 is pushed upward by the cam 18 so that the fixing roller 11 and the endless belt 13 are apart from the pressure roller 14. The endless belt 13 is applied the tension T2 (FIG. 8) in such a range that the impression is not formed on the endless belt 13 and that the endless belt 13 does not slip over the fixing roller 11 and the like. When a job of the image forming unit 8 is generated, or when the main controller 20 determines it necessary to heat the heating roller 12 and the pressure roller 14 to keep their temperatures, the main controller 20 instructs the unit controller 10 to perform a warm-up operation. The unit controller 10 drives the roller drive motor 23, according to the instruction from the main controller 20. The pressure roller 14 rotates, and therefore the fixing roller 11 rotates by means of the gears 21 and 22. As the fixing roller 11 rotates, the endless belt 13 moves and the heating roller 12 rotates.

The unit controller 10 further drives the halogen lamp 12*h* according to the surface temperature of the heating roller 12 detected by the thermistor 25, and drives the halogen lamp 14*h* according to the surface temperature of the pressure roller 14 detected by the thermistor 26. The fixing roller 11 and the endless belt 13 are heated by the heat transmitted from the heating roller 12. Since the endless belt 13 is heated while the endless belt 13 is moving, the endless belt 13 can be uniformly heated.

The main controller 20 calculates the time when the front end of the recording sheet reaches the nip portion 19, according to the detection signal from the sheet sensor 90. The main controller 20 instructs the unit controller 10 to close the nip portion 19 when the recording sheet reaches the nip portion 19. The unit controller 10 drives the cam drive motor 24 according to the instruction from the main controller 20. The cam 18 rotates by a predetermined angle, and the circumferential end surface of the cam 18 separates from the swing lever 15, so that the swing lever 15 is swung downward by the force of the lever urging spring 16. As a result, as shown in FIG. 2, the fixing roller 11 is pressed against the pressure roller 14 via the endless belt 13. When the fixing roller 11 shifts downward, the heating roller 12 also shifts downward, so that the tension applying spring 17 is compressed. The endless belt 13 is applied the tension T1 (FIG. 8) in such a range that the endless belt 13 does not slip over the fixing roller 11 during the following image fixing operation.

The recording sheet that carries the toner image formed by the image forming unit 8 is fed in the nip portion 19 between the endless belt 13 and the pressure roller 14, with the toner image side facing upward (i.e., the endless belt 13 side). The recording sheet is pressed and heated in the nip portion 19 between the endless belt 13 and the pressure roller 14, so that the toner image is fixed to the surface of the recording sheet. The recording sheet passes through the nip portion 19, and is discharged out of the image forming apparatus, by means the pair of rollers 92 disposed at the downstream side of the fixing device 1.

The main controller 20 calculates the time when the rear end of the recording sheet passes through the nip portion 19, according to the detection signal from the sheet sensor 90. The main controller 20 instructs the unit controller 10 to open the nip portion 19 when the recording sheet passes through the nip portion 19. The unit controller 10 drives the cam drive motor 24 according to the instruction from the main controller 20. The cam 18 rotates by a predetermined angle, and pushes the swing lever 15 upward overcoming the force of the lever urging spring 16. As a result, as shown in FIG. 5, the fixing roller 11 and the endless belt 13 separate from the pressure roller 14. The unit controller 10 stops the roller drive motor 23 and stops the power supply to the halogen lamps 12*h* and 14*h* of the heating roller 12 and the pressure roller 14.

During the above described image fixing operation, when the main controller 20 detects a jam of the recording sheet based on the signal from the sheet sensor 90 or the like, the main controller 20 instructs the unit controller 10 to open the nip portion 19. The unit controller 10 drives the cam drive motor 24 so that the cam 18 rotates and pushes the swing lever 15 upward. Further, the unit controller 10 stops the roller drive motor 23, and stops the power supply to the halogen lamps 12*h* and 14*h*. As a result, the fixing roller 11 and the endless belt 13 separate from the pressure roller 14, and therefore the jammed recording sheet can be easily removed. Thus, the endless belt 13 and the pressure roller 14 do not suffer thermal damage.

As described above, according to Embodiment 1, the fixing roller 11 and the endless belt 13 are apart from the pressure roller 14 except when the image fixing operation is performed, and therefore it is possible to prevent the impression from being formed on the endless belt 13 and the rollers 11, 12 and 14. As a result, the non-uniformity of the fixed image can be reduced, and the lifetimes of the endless belt 13 and the rollers 11, 12 and 14 can be lengthened.

Moreover, the pressure roller 14 has the internal heat source, i.e., the halogen lamp 14*h*, so that the temperature control can be performed in a state where the fixing roller 11 and the endless belt 13 separate from the pressure roller 14. Therefore, it is possible to reduce the heat transmission between a group of components heated by the halogen lamp 12*h* (i.e., the fixing roller 11, the heating roller 12 and the endless belt 13) and the pressure roller 14 heated by the halogen lamp 14*h*. As a result, the halogen lamps 12*h* and 14*h* can be independently controlled, so that a rapid temperature control is enabled.

Further, since the temperature control can be performed in a state where the endless belt 13 separates from the pressure roller 14, the endless belt 13 and the pressure roller 14 do not nip the solid toner that may adhere to the endless belt 13 or the like. As a result, it is possible to prevent the endless belt 13 and the pressure roller 14 from being damaged by the solid toner.

Furthermore, the fixing roller 11 shifts in the direction away from the pressure roller 14 to decrease the tension of the endless belt 13, and therefore the endless belt 13 is not applied a large tension for a long time. Thus, the lifetime of the endless belt 13 can be lengthened.

In addition, the fixing roller 11 shifts but the pressure roller 14 does not shifts, and therefore the feeding path of the recording sheet defined by the surface of the pressure roller 14 can be stabilized. In addition, the positional relationship between the pressure roller 14 and the thermistor 26 does not change, so that a temperature control can be stably performed.

Moreover, the gears 21 and 22 are able to transmit the rotation to each other even when the fixing roller 11 and the endless belt 13 separate from the pressure roller 14. Thus, the fixing roller 11, the heating roller 12, the endless belt 13 and the pressure roller 14 can be driven by a common driving source during the warm-up operation.

Furthermore, even when the operation of the image forming unit 8 takes a long time, the fixing roller 11 can be kept apart from the pressure roller 14. Accordingly, even when the image forming unit 8 slowly performs its operation (for example, when a thick or particular recording sheet is used) or even when the image forming unit 8 switches the job, it is possible to minimize the heat transmission between the endless belt 13 and the pressure roller 14. Accordingly, a temperature control can be easily performed.

Additionally, if the jam of the recording sheet occurs, the fixing roller 11 and the endless belt 13 separate from the pressure roller 14, with the result that the jammed recording sheet can be easily removed. Therefore, the recording sheet is not nipped by the endless belt 13 and the pressure roller 14 for a long time. Thus, the endless belt 13 and the pressure roller 14 do not suffer thermal damage.

Figure 10A:
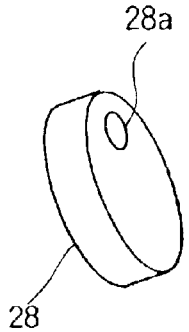
FIGS. 10A and 10B are a perspective view and a front view illustrating a modification of a cam of the fixing device according to Embodiment 1 of the present invention.
Figure 10B:
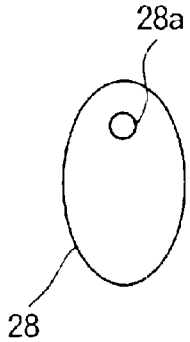
Figure 10C:
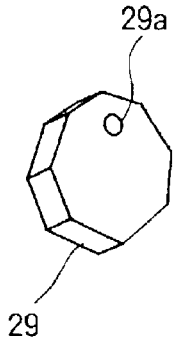
FIGS. 10C and 10D are a perspective view and a front view illustrating another modification of the cam of the fixing device according to Embodiment 1 of the present invention.
Figure 10D:
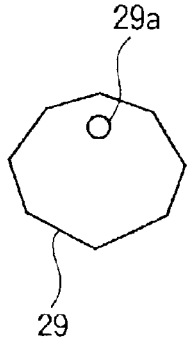

In the above description, the cam 18 is in the form of an eccentric circular disk. However, the cam 18 can have other shape in which the distance from the rotation center to the circumferential end surface is not uniform. FIGS. 10A and 10B are respectively a perspective view and a front view of a modification of the cam. FIGS. 10C and 10D are respectively a perspective view and a front view of another modification of the cam. As shown in FIGS. 10A and 10B, a cam 28 according to the modification is in the form of an ellipse, and has a rotation axis 28*a* shifted from a center of a longer axis of the ellipse. As shown in FIGS. 10C and 10D, a cam 29 according to another modification is in the form of an octagon, and has a rotation axis 29*a* shifted from the center of the octagon.

Embodiment 2

Figure 11:
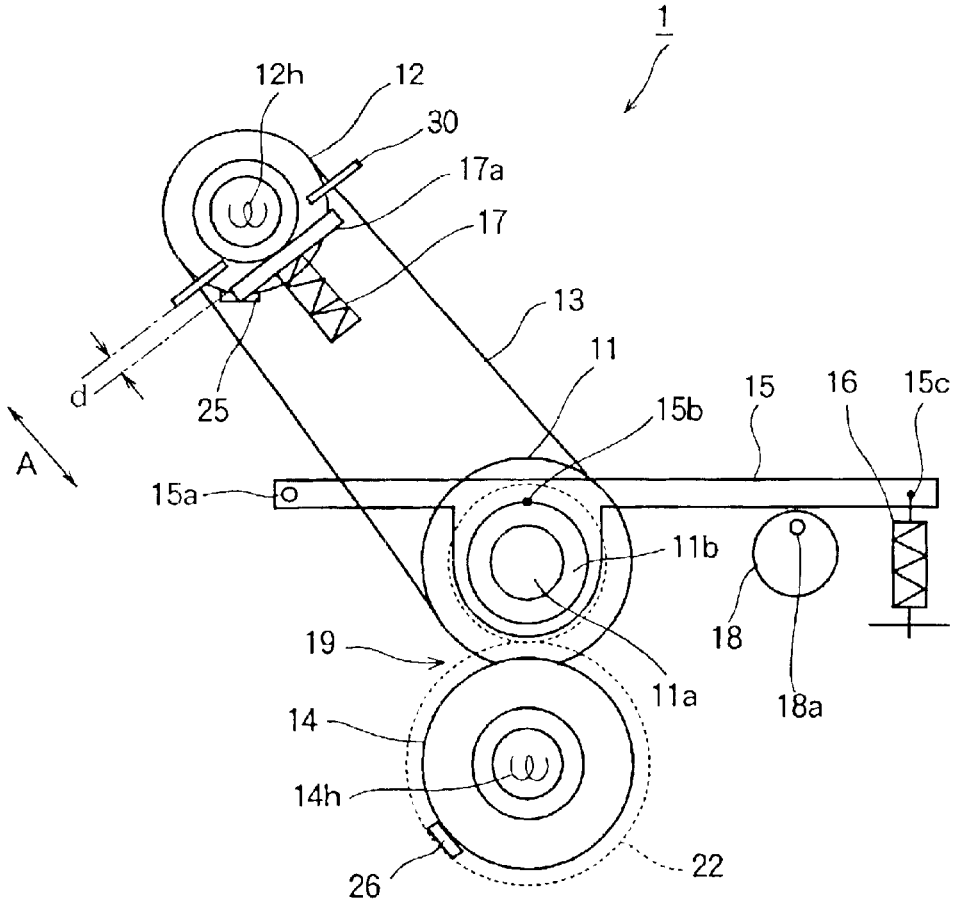
FIG. 11 is a side view of the fixing device according to Embodiment 2 of the present invention.
Figure 12:
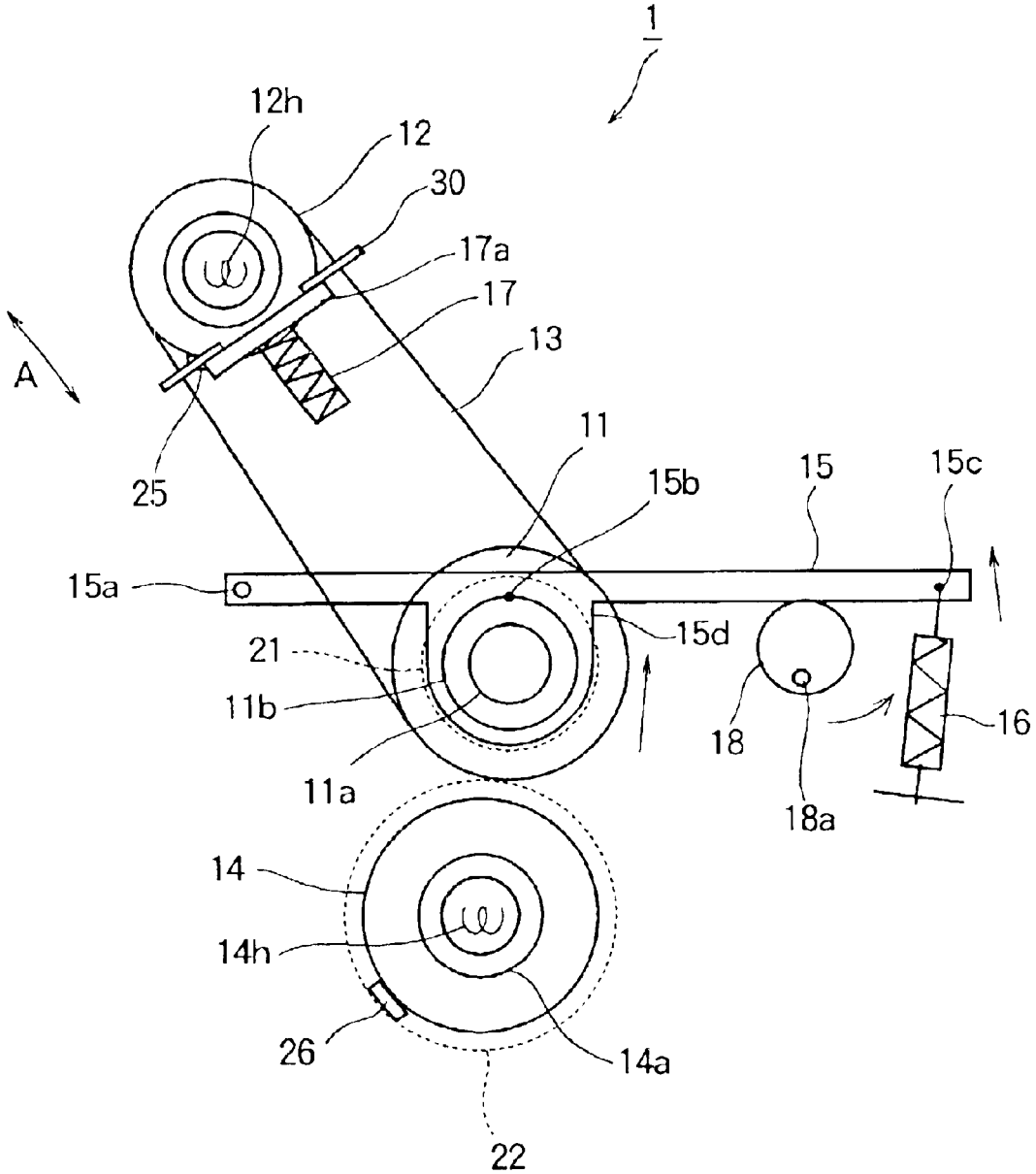
FIG. 12 is a side view illustrating the operation of the fixing device according to Embodiment 2 of the present invention.

FIGS. 11 and 12 are side views illustrating the structure of the fixing device 1 according to Embodiment 2. FIG. 11 shows the fixing device 1 when the fixing roller 11 is pressed against the pressure roller 14 via the endless belt 13. FIG. 12 shows the fixing device 1 when the fixing roller 11 and the endless belt 13 separate from the pressure roller 14. In Embodiment 2, a mechanism is provided for releasing the tension of the endless belt 13 applied by the tension applying spring 17.

As shown in FIG. 11, a contact member 17*a* is mounted to the tip of the tension applying spring 17. The contact member 17*a* abuts against a stopper (i.e., a release mechanism) 30 when the contact member 17*a* shifts in the direction away from the fixing roller 11. The stopper 30 is fixed to the above described guide member 12*d* (FIG. 4) that supports the tension applying spring 17. The stopper 30 causes the tension applying spring 17 to stop applying the tension to the endless belt 13, when the fixing roller 11 and the endless belt 13 separate from the pressure roller 14.

When the fixing roller 11 and the endless belt 13 are pressed against the pressure roller 14, the contact member 17*a* of the tension applying spring 17 separates from the stopper 30 by the distance "d". In this state, as was described in the Embodiment 1, the tension applying spring 17 applies the tension to the endless belt 13.

Figure 13A:
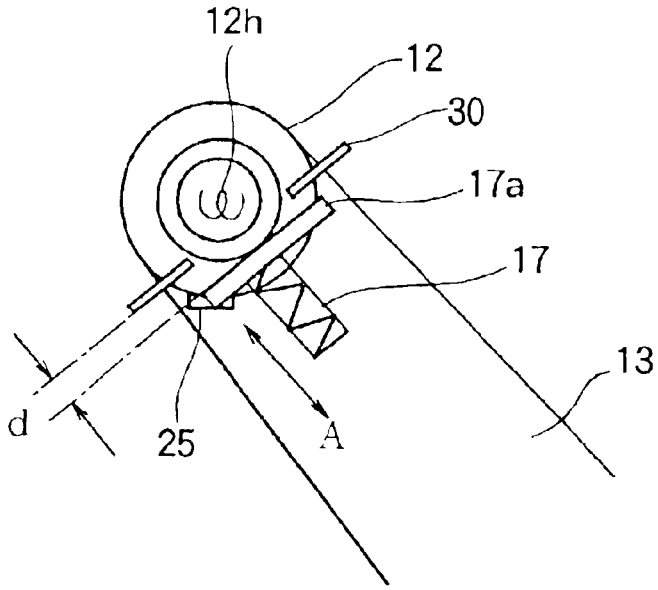
FIGS. 13A and 13B are enlarged views illustrating how a spring and a stopper of the fixing device contact each other according to Embodiment 3 of the present invention.
Figure 13B:
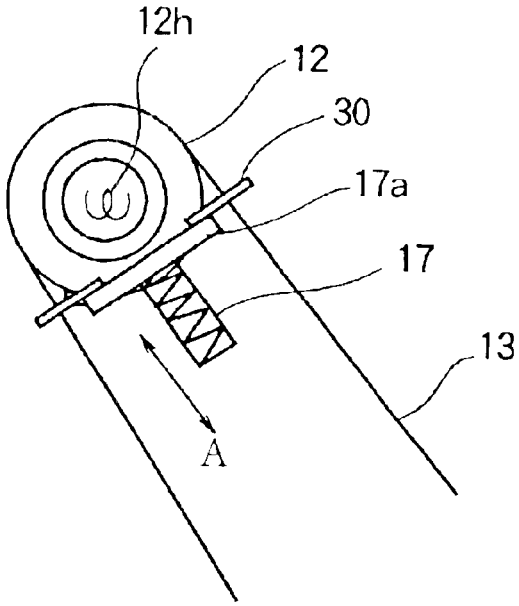

As shown in FIG. 12, when the fixing roller 11 and the endless belt 13 separate from the pressure roller 14, i.e., when the fixing roller 11 shifts upward, the contact member 17*a* of the tension applying spring 17 abuts against the stopper 30. As the contact member 17*a* abuts against the stopper 30, the stopper 30 receives the force of the tension applying spring 17. Thus, no tension is applied to the endless belt 13, and therefore the endless belt 13 slackens. FIG. 13A shows the state where the contact member 17*a* of the tension applying spring 17 separates from the stopper 30. FIG. 13B shows the state where the contact member 17*a* of the tension applying spring 17 abuts against the stopper 30.

In Embodiment 2, when the fixing roller 11 and the endless belt 13 separate from the pressure roller 14, i.e., when the endless belt 13 slackens, the fixing roller 11 is not intended to rotate. It means that the gears 21 and 22 do not necessarily transmit the rotation to each other. However, in order to prevent the tooth top portions of the gears 21 and 22 from abutting each other when the gears 21 and 22 mesh each other, it is preferable that the addendum circles Hi and H2 of the gears 21 and 22 intersect each other as shown in FIG. 6B. Such an arrangement is accomplished, for example, when the module of each of the gears 21 and 22 is equal to 1 mm, and the gap between the fixing roller 11 and the pressure roller 14 is smaller than or equal to 1 mm, as was described in Embodiment 1.

Figure 14:
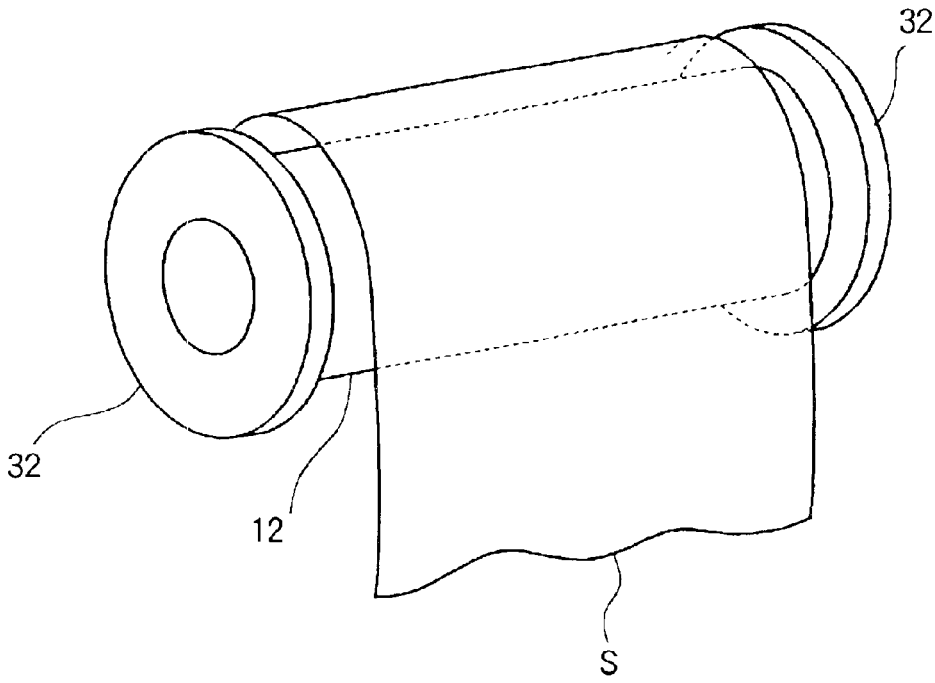
FIG. 14 is a perspective view of position regulating rings for the endless belt of the fixing device according to Embodiment 3 of the present invention.

FIG. 14 is a perspective view of the heating roller 12 of the fixing device 1 according to Embodiment 2. Position regulating rings (i.e., a belt regulating mechanism) 32 are fixed to both ends of the heating roller 12 in the axial direction of the heating roller 12. The position regulating rings 32 prevent the endless belt 13 from deviating in the axial direction of the heating roller 12. The same position regulating rings 32 are also provided to the fixing roller 11.

The operation of the image forming apparatus will be described. As shown in FIG. 12, in the standby state, the cam 18 pushes the swing lever 15 upward so that the fixing roller 11 and the endless belt 13 separate from the pressure roller 14. When the job of the image forming unit 8 is generated, or when the main controller 20 determines it necessary to heat the heating roller 12 and the pressure roller 14 to keep their temperatures, the main controller 20 instructs the unit controller 10 to perform a heating operation. The unit controller 10 drives the halogen lamps 12*h* and 14*h* based on the surface temperatures detected by the thermistor 25 and 26. Different from the warm-up operation in Embodiment 1, the roller drive motor 23 is not driven in this heating operation.

The main controller 20 calculates the time when the front end of the recording sheet reaches the nip portion 19 according to the detection signal from the sheet sensor 90, and instructs the unit controller 10 to close the nip portion 19 when the recording sheet reaches the nip portion 19. The unit controller 10 drives the cam drive motor 24 according to the instruction from the main controller 20. The cam 18 rotates by a predetermined angle, and the circumferential end surface of the cam 18 separates from the swing lever 15, so that the swing lever 15 is swung downward by the force of the lever urging spring 16. As a result, as shown in FIG. 11, the fixing roller 11 is pressed against the pressure roller 14 via the endless belt 13. The endless belt 13 is applied the tension T1 (FIG. 8) in such a range that the endless belt 13 does not slip over the fixing roller 11 during the image fixing operation. Then, the toner image is fixed to the recording sheet, as was described in Embodiment 1.

The main controller 20 calculates the time when the rear end of the recording sheet passes through the nip portion 19 according to the detection signal from the sheet sensor 90. The main controller 20 instructs the unit controller 10 to open the nip portion 19 when the rear end of the recording sheet passes through the nip portion 19. The unit controller 10 drives the cam drive motor 24 according to the instruction from the main controller 20. The cam 18 rotates by a predetermined angle, and pushes the swing lever 15 upward overcoming the force of the lever urging spring 16. As a result, as shown in FIG. 12, the fixing roller 11 and the endless belt 13 separate from the pressure roller 14. The unit controller 10 stops the rotation of the roller drive motor 23 and stops the power supply to the halogen lamps 12*h* and 14*h*. Consequently, the fixing roller 11 shifts upward, so that the contact member 17*a* of the tension applying spring 17 abuts against the stopper 30, and therefore the endless belt 13 slackens.

During the above described image fixing operation, when the main controller 20 detects the jam of the recording sheet based on the signal from the sheet sensor 90 or the like, the main controller 20 instructs the unit controller 10 to open the nip portion 19. The unit controller 10 drives the cam drive motor 24 so that the cam 18 rotates and pushes the swing lever 15 upward. Further, the unit controller 10 stops the rotation of the roller drive motor 23, and stops the power supply to the halogen lamps 12*h* and 14*h*. The fixing roller 11 and the endless belt 13 separate from the pressure roller 14, and therefore the jammed recording sheet can be easily removed. Thus, it is possible to prevent the thermal damage to the endless belt 13 and the pressure roller 14.

As described above, according to Embodiment 2, the endless belt 13 slackens when the fixing roller 11 and the endless belt 13 separate from the pressure roller 14. Thus, it is possible to ensure that no impression is formed on the endless belt 13 and the rollers 11, 12 and 14. Accordingly, the lifetimes of the endless belt 13 and the rollers 11, 12 and 14 can be further lengthened.

Particularly, Embodiment 2 is effective in lengthening the lifetimes of the endless belt 13 and the rollers 11, 12 and 14 in the case where the impression is formed even by a tension in such a range that the endless belt 13 does not slip over the fixing roller 11 and the like for a long time, i.e., in the case where the tension T3 is smaller than the tension T4 in FIG. 8.

Figure 15:
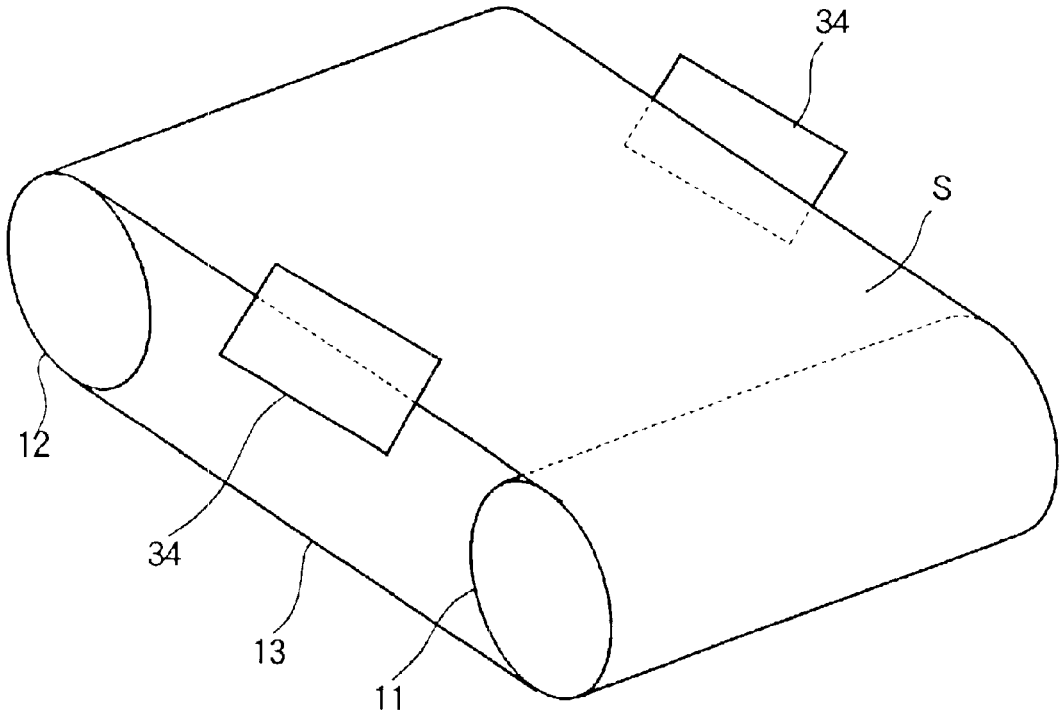
FIG. 15 is a perspective view of position regulating members for the endless belt of the fixing device according to Embodiment 3 of the present invention.

In the above description, the fixing roller 11 and the heating roller 12 are provided with position regulating rings 32 for regulating the position of the endless belt 13. However, the position regulating rings 32 can be replaced by position regulating members 34 as shown in FIG. 15. The position regulating members 34 are disposed between the fixing roller 11 and the heating roller 12 in such a manner that the regulating members 34 substantially contact both ends of the endless belt 13 in the width direction of the endless belt 13.

Figure 16A:
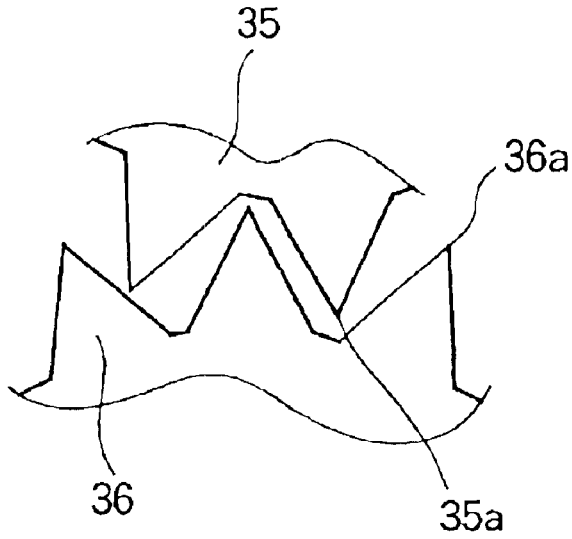
FIGS. 16A and 16B are enlarged views illustrating a modification of gears of the fixing device according to Embodiment 2 of the present invention.
Figure 16B:
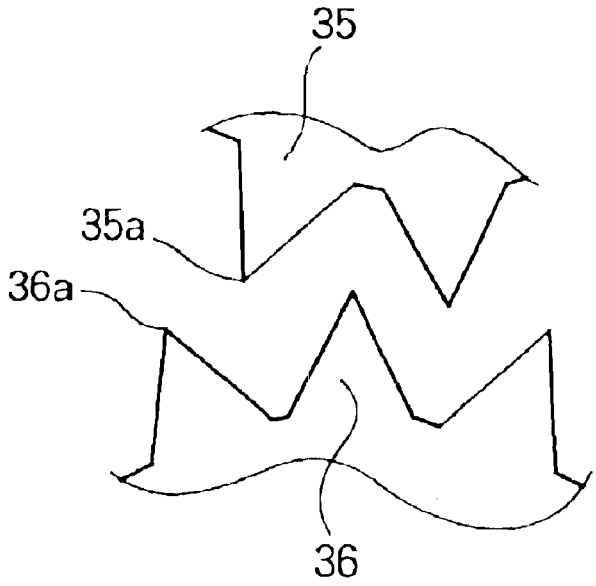

Further, in the above description, the addendum circles H1 and H2 of the gears 21 and 22 preferably intersect each other as shown in FIG. 6B. Instead, it is also preferable to use gears 35 and 36 which tooth top portions 35*a* and 36*a* are pointed as shown in FIGS. 16A and 16B. With such an arrangement, it is possible to prevent the tooth top portions 35*a* and 36*a* from abutting each other when the gears 35 and 36 mesh each other as shown in FIG. 16A, after the gears 35 and 35 disengage from each other as shown in FIG. 16B.

Embodiment 3

Figure 17:
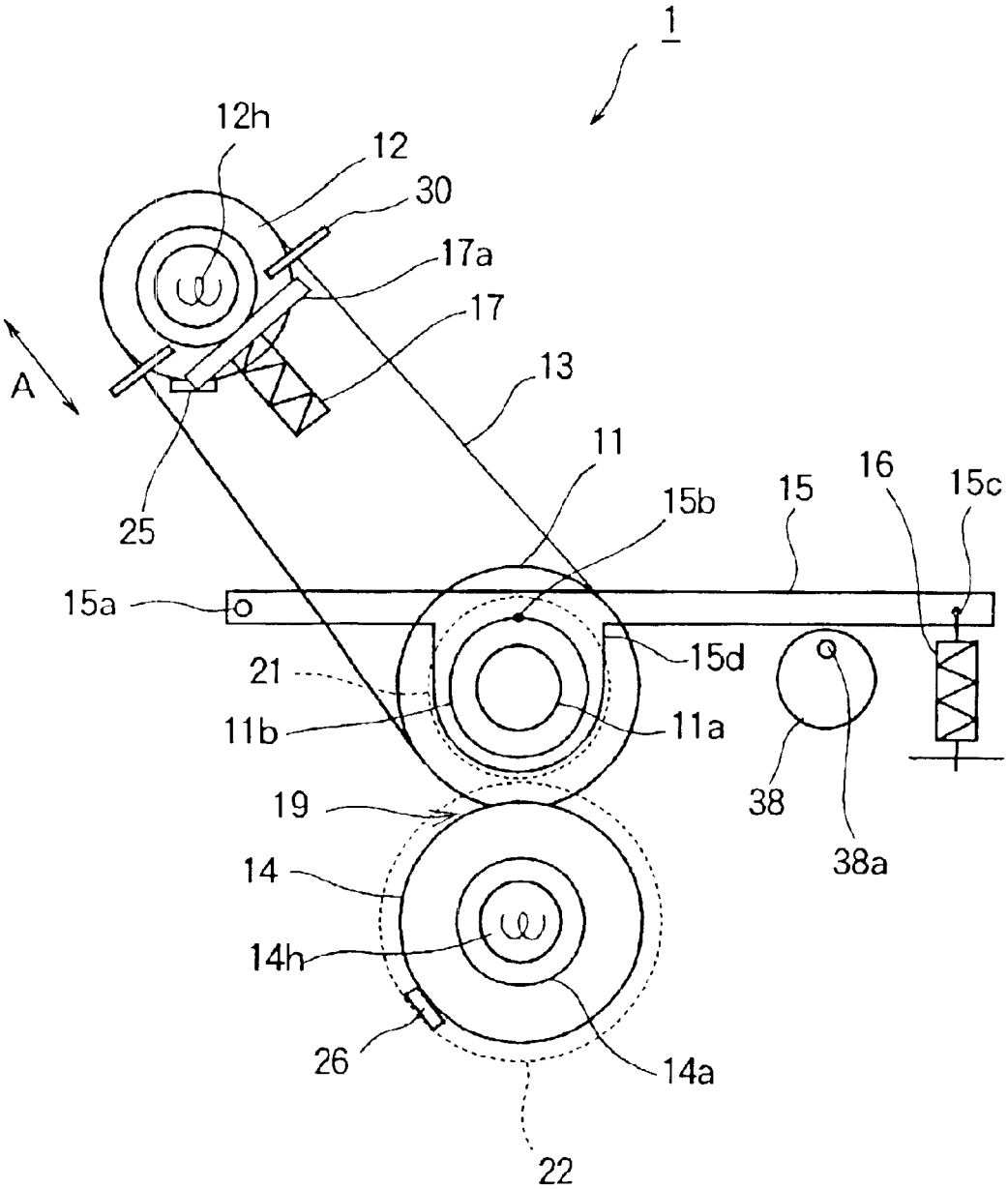
FIG. 17 is a side view of the fixing device according to Embodiment 3 of the present invention.

FIG. 17 is a side view of the fixing device 1 according to Embodiment 3. FIG. 18 illustrates a cam 38 of the fixing device 1 according to Embodiment 3. In Embodiment 3, the fixing roller 11 can have one of two positions at different distances from the pressure roller 14.

The fixing device 1 according to Embodiment 3 has a stopper 30 for restricting the function of the tension applying spring 17, and the position regulating rings 32 (FIG. 14) for preventing the deviation of the endless belt 13, as was described in Embodiment 2. Further, the fixing device 1 has the cam 38 that pushes the swing lever 15 upward. The amount by which the cam 38 pushes the swing lever 15 upward is selectable, so that the fixing roller 11 can have one of two positions at different distances from the pressure roller 14.

The cam 38 is substantially in the form of a disk, and has a rotation center 38*a* at a position shifted from the center of the disk. As shown in FIG.17, when the circumferential end surface closest to the rotation center 38*a* is above the rotation center 38*a*, the cam 38 is apart from the swing lever 15. This position of the cam 38 is referred to as a rotational reference position.

When the cam 38 is apart from the swing lever 15, the swing lever 15 is urged downward by means of the lever urging spring 16, so that the fixing roller 11 is pressed against the pressure roller 14 via the endless belt 13. As was described in Embodiment 1, by means of the tension applying spring 17, the endless belt 13 is applied the tension T1 (FIG. 8) in such a range that the endless belt 13 does not slip over the fixing roller 11 during the image fixing operation.

Figure 18A:
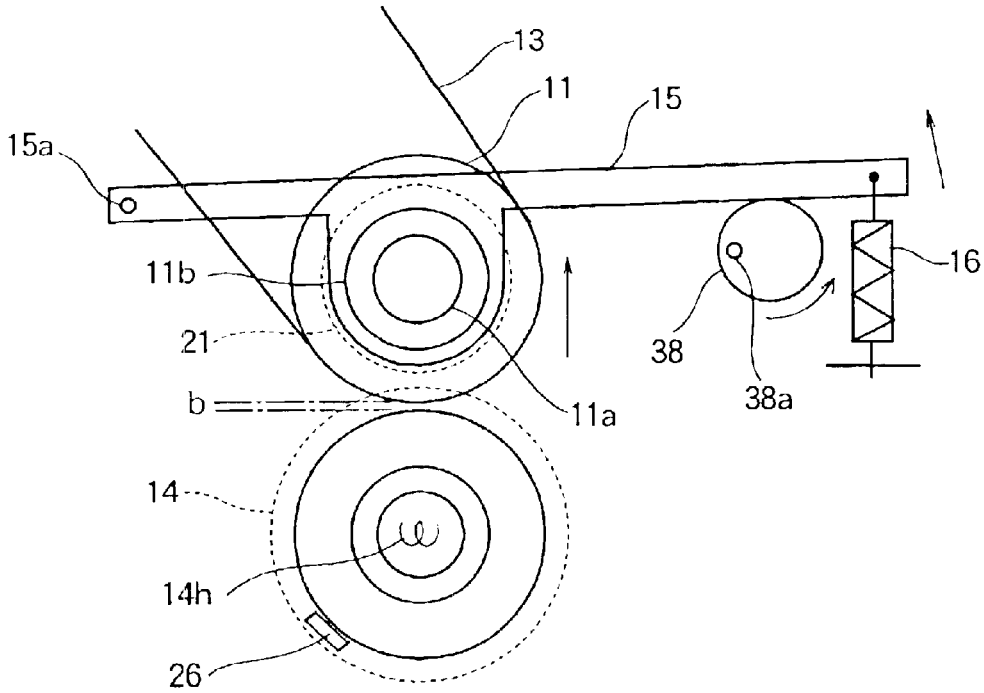
FIGS. 18A and 18B are side views illustrating the operation of the cam of the fixing device according to Embodiment 3 of the present invention.
Figure 18B:
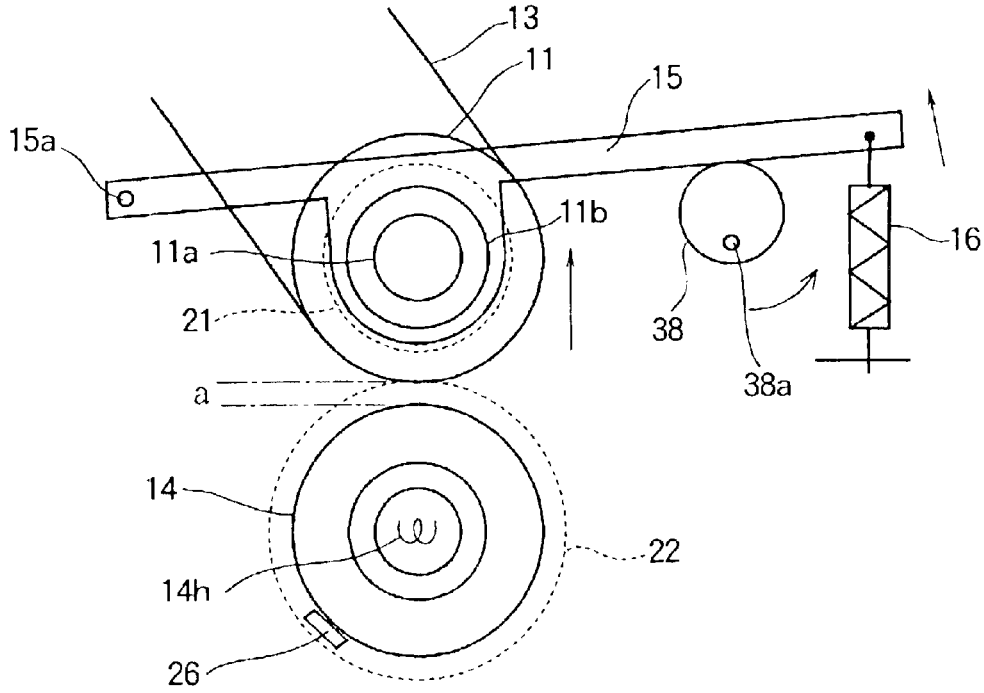

FIGS. 18A and 18B are enlarged side views illustrating the operation of the cam 38. The cam 38 is able to stop at a first rotational position where the cam 38 rotates 90 degrees from the above described rotational reference position, and a second rotational position where the cam 38 rotates 180 degrees from the rotational reference position. When the cam 38 is at the first rotational position, the circumferential end surface of the cam 38 abuts against the swing lever 15 to push the swing lever 15 upward, so that a gap "b" is formed between the endless belt 13 and the pressure roller 14, as shown in FIG. 18A. When the cam 38 is at the second rotational position, the cam 38 further pushes the swing lever 15 upward, so that a gap "a", larger than the gap "b", is formed between the endless belt 13 and the pressure roller 14.

Figure 19:
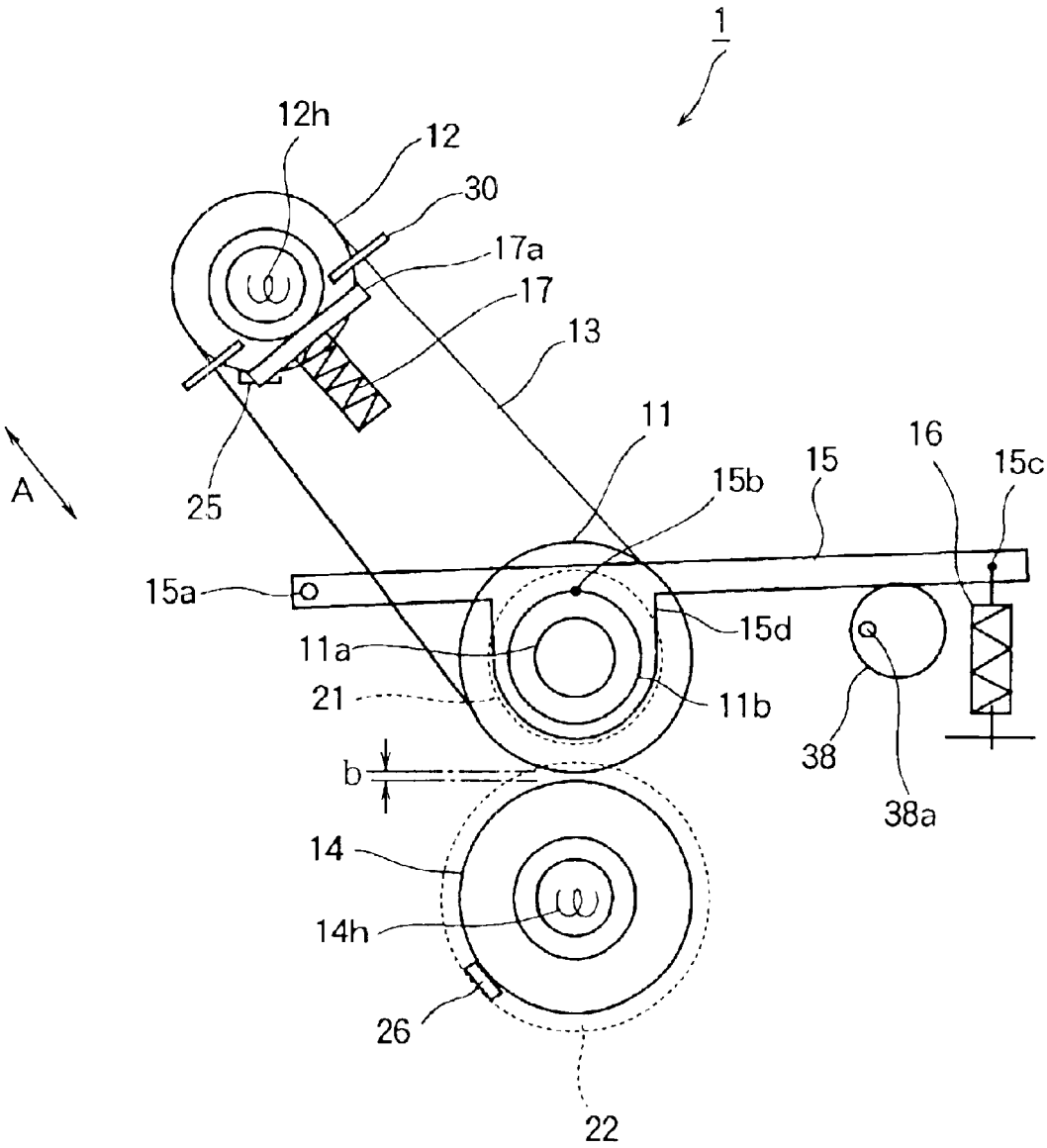
FIG. 19 is a side view illustrating the first step of the operation of the fixing device according to Embodiment 3 of the present invention.
Figure 20:
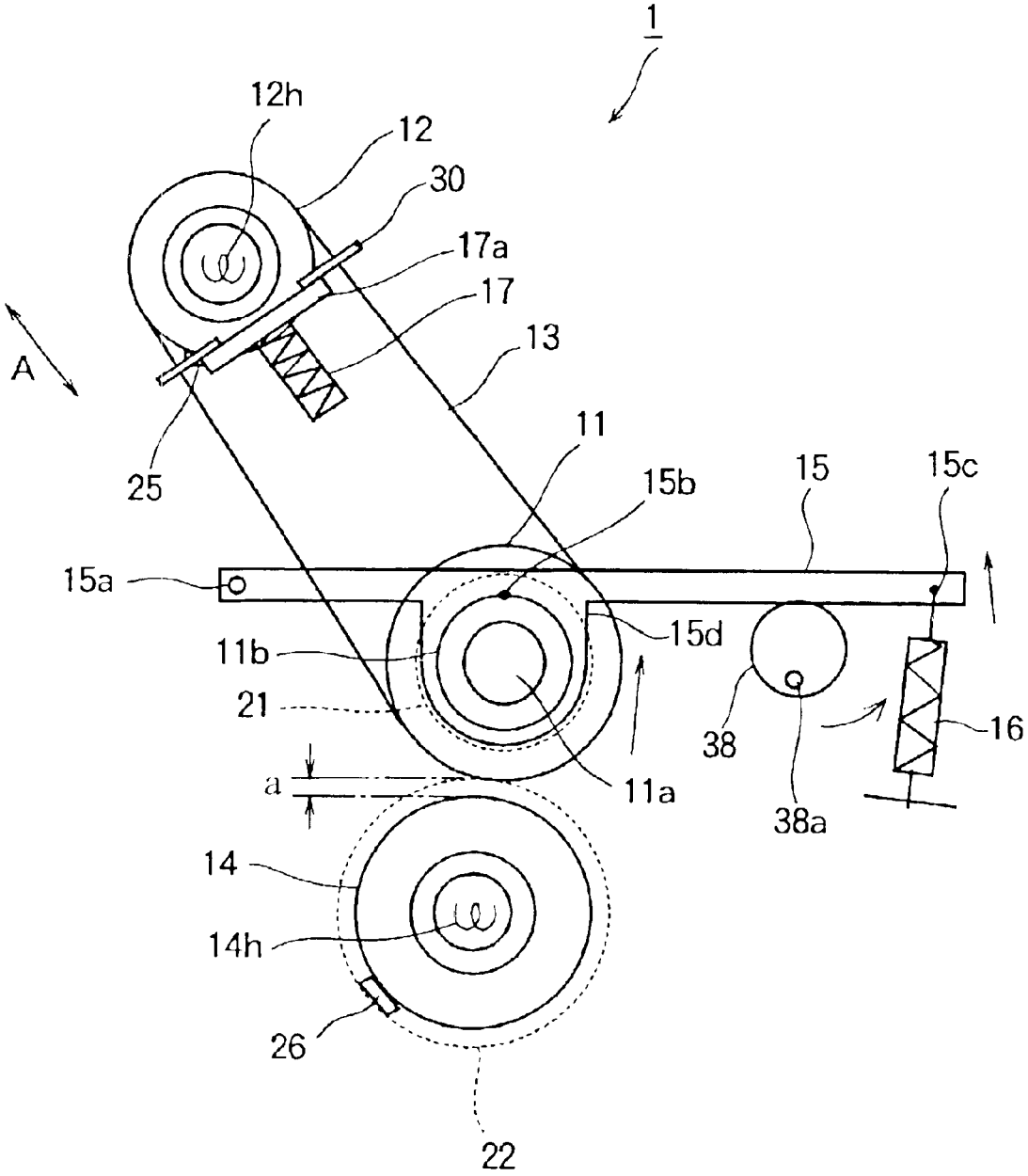
FIG. 20 is a side view illustrating the second step of the operation of the fixing device according to Embodiment 3 of the present invention.

FIGS. 19 and 20 are side views illustrating the fixing device 1 when the cam 38 is respectively in the first and second rotational positions. As shown in FIG. 19, when the cam 38 is in the first rotational position and the gap "b" is formed between the endless belt 13 and the pressure roller 14, the heating roller 12 shifts in the direction away from the fixing roller 11, resulting from the upward shifting of the fixing roller 11. Thus, the length of the tension applying spring 17 increases, and therefore the tension applied to the endless belt 13 decreases. In this state, the endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like. Although the pitch circles of the gears 21 and 22 separate from each other, the addendum circles H1 and H2 (FIG. 6B) of the gears 21 and 22 intersect each other, so that the gears 21 and 22 are able to transmit the rotation to each other.

As shown in FIG. 20, when the cam 38 is in the second rotational position and the gap "a" is formed between the endless belt 13 and the pressure roller 14, the contact member 17*a* of the tension applying spring 17 abuts against the stopper 30, so that the endless belt 13 is applied no tension and therefore the endless belt 17 slackens. Although it is possible that the gears 21 and 22 completely separate from each other, it is preferable that the addendum circles H1 and H2 (FIG. 6B) of the gears 21 and 22 intersect each other, in order to prevent the tooth top portions of the gears 21 and 22 from abutting each other when the gears 21 and 22 mesh each other.

The fixing roller 11 and the heating roller 12 are provided with position regulating rings 32 (FIG. 14) for preventing the deviation of the endless belt 13 when the endless belt 13 slackens.

The operation of the image forming apparatus will be described. As shown in FIG. 12, in the standby state, the cam 38 is in the second position and therefore the gap "a" is formed between the endless belt 13 and the pressure roller 14, so that the endless belt 13 slackens.

When the job of the image forming unit 8 is generated, or when the main controller 20 determines it necessary to heat the heating roller 12 and the pressure roller 14 to keep their temperatures, the main controller 20 instructs the unit controller 10 to perform the warm-up operation. The unit controller 10 drives the cam drive motor 24 according to the instruction from the main controller 20, so that the cam 38 rotates to the first rotational position. The swing lever 15 swings downward about the fulcrum 15*a* by the force of the lever urging spring 16, so that the fixing roller 11 and the endless belt 13 shift toward the pressure roller 14 until the gap "b" is formed between the endless belt 13 and the pressure roller 14 as shown in FIG. 19. In this state, the endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like. Further, the gears 21 and 22 move close to each other so that the gears 21 and 22 are able to transmit the rotation to each other. The unit controller 10 starts the rotation of the roller drive motor 23. When the roller drive motor 23 rotates the pressure roller 14, the rotation of the pressure roller 14 is transmitted to the fixing roller 11, and therefore the endless belt 13 moves and the heating roller 12 rotates. The unit controller 10 further drives the halogen lamps 12*h* and 14*h*. The fixing roller 11, the heating roller 12, the endless belt 13 and the pressure roller 14 are uniformly heated.

The main controller 20 calculates the time when the front end of the recording sheet reaches the nip portion 19 according to the detection signal from the sheet sensor 90, and instructs the unit controller 10 to close the nip portion 19 when the recording sheet reaches the nip portion 19. According to the instruction from the main controller 20, the unit controller 10 drives the cam drive motor 24 so that the cam 38 rotates to the rotational reference position. The circumferential end surface of the cam 38 separates from the swing lever 15, so that the swing lever 15 swings downward by the force of the lever urging spring 16. As a result, as shown in FIG. 17, the fixing roller 11 is pressed against the pressure roller 14 via the endless belt 13. The endless belt 13 is applied the tension T1 (FIG. 8) in such a range that the endless belt 13 does not slip over the fixing roller 11 during the image fixing operation. Then, the toner image is fixed to the recording sheet in the nip portion 19 between the endless belt 13 and the pressure roller 14, as was described in Embodiment 1.

The main controller 20 calculates the time when the rear end of the recording sheet passes through the nip portion 19 according to the detection signal from the sheet sensor 90. The main controller 20 instructs the unit controller 10 to open the nip portion 19 when the rear end of the recording sheet passes through the nip portion 19. The unit controller 10 drives the cam drive motor 24 according to the instruction from the main controller 20, so that the cam 38 rotates by 180 degrees and pushes the swing lever 15 upward overcoming the force of the lever urging spring 16. As a result, as shown in FIG. 20, the fixing roller 11 and the endless belt 13 separate from the pressure roller 14. The unit controller 10 stops the rotation of the roller drive motor 23 and stops the power supply to the halogen lamps 12*h* and 14*h*. As the fixing roller 11 shifts upward, the contact member 17*a* of the tension applying spring 17 abuts against the stopper 30, so that the endless belt 13 slackens.

During the above described image fixing operation, when the main controller 20 detects the jam of the recording sheet based on the signal from the sheet sensor 90 or the like, the main controller 20 instructs the unit controller 10 to open the nip portion 19. Consequently, the fixing roller 11 and the endless belt 13 separate from the pressure roller 14, and therefore the jammed recording sheet can be easily removed.

As described above, according to Embodiment 3, the fixing roller 11 (as well as the endless belt 13) can have one of two positions at different distances from the pressure roller 14, and therefore both of the advantages of Embodiments 1 and 2 can be obtained. Particularly, it is possible to perform the warm-up operation while the fixing roller 11 and the endless belt 13 are apart from the pressure roller 14. Moreover, the endless belt 13 slackens in the standby state, and therefore the lifetimes of the endless belt 13, the rollers 11, 12 and 14 can be lengthened.

In the above description, the cam 38 is in the form of an eccentric disk having the rotation axis shifted from the center. However, the cam 38 can have other shape in which the distance from the rotation axis to the circumferential end surface is not uniform, as shown in FIGS. 10A through 10D. Further, the position regulating ring 32 can be replaced by the position regulating members 34 disposed between the fixing roller 11 and the heating roller 12 as shown in FIG. 15. The position regulating members 34 contact both ends of the endless belt 13 to regulate the position of the endless belt 13. Further, the gears 21 and 22 can be replaced by the gears 35 and 36 which tooth top portions are pointed as shown in FIGS. 16A and 16B.

Embodiment 4

Figure 21:
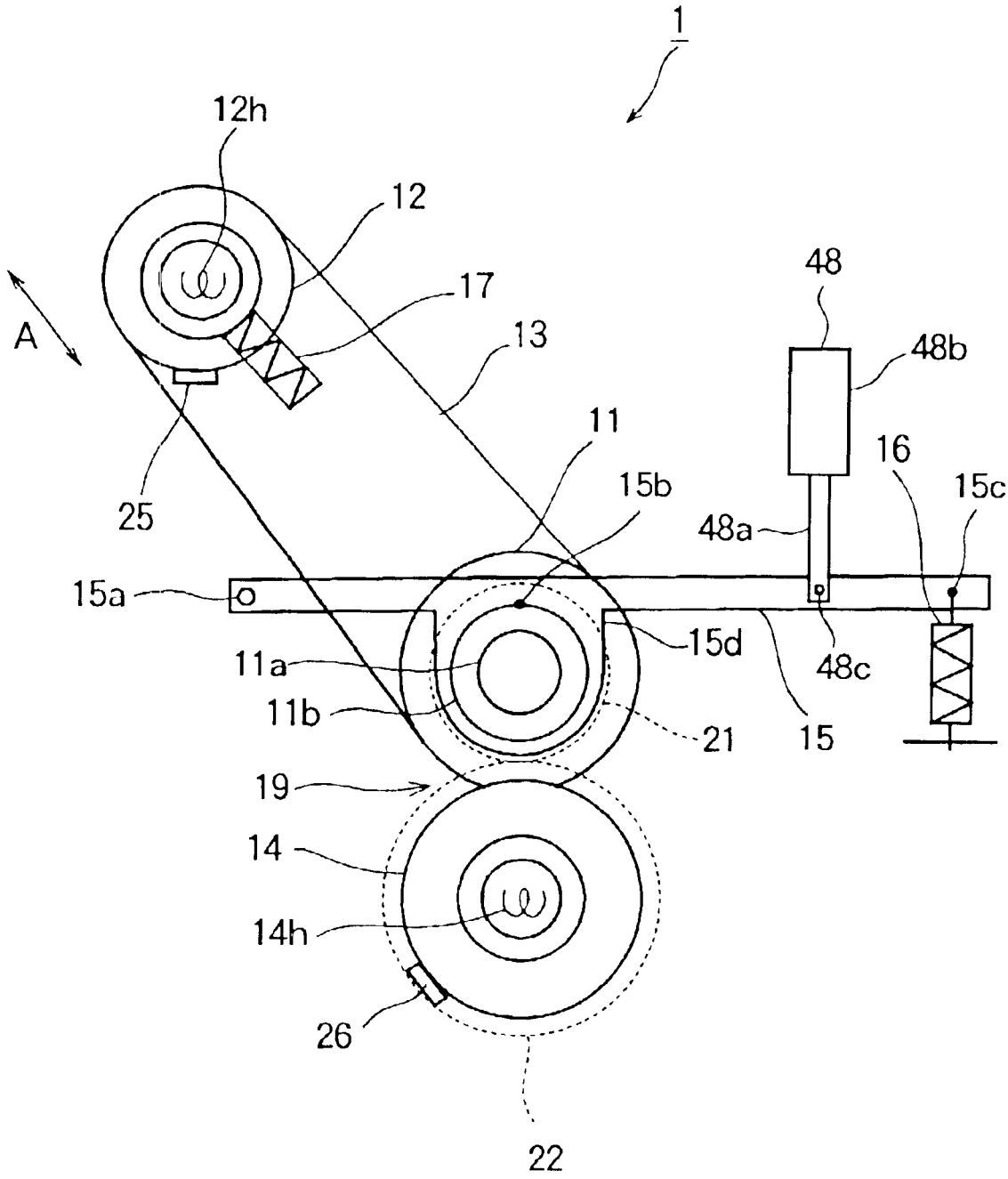
FIG. 21 is a side view of the fixing device according to Embodiment 4 of the present invention.

FIG. 21 is a side view of the fixing device 1 according to Embodiment 4. In Embodiment 4, a solenoid 48 replaces the cam 18 in Embodiment 1. The solenoid 48 includes a body 48*b* disposed above the swing lever 15 and a vertically movable plunger 48*a* projected downward from the bottom of the body 48*b*. The bottom end of the plunger 48*a* of the solenoid 48 is connected to a pin 48*c* disposed between the spring action point 15*c* and the roller action point 15*b*. When an electric current flows through a coil in the body 48*b* of the solenoid 48 (i.e., an ON state), a drive force is applied to the plunger 48*a* in the upward direction. When no electric current flows through the coil (i.e., an OFF state), no drive force is applied to the plunger 48*a*.

In the OFF state, the swing lever 15 is not pulled by the solenoid 48, so that the swing lever 15 is urged downward by the force of the lever urging spring 16, and therefore the fixing roller 11 is pressed against the pressure roller 14 via the endless belt 13. In this state, the endless belt 13 is applied the tension T1 (FIG. 8) in such a range that the endless belt 13 does not slip over the fixing roller 11 during the image fixing operation.

Figure 22:
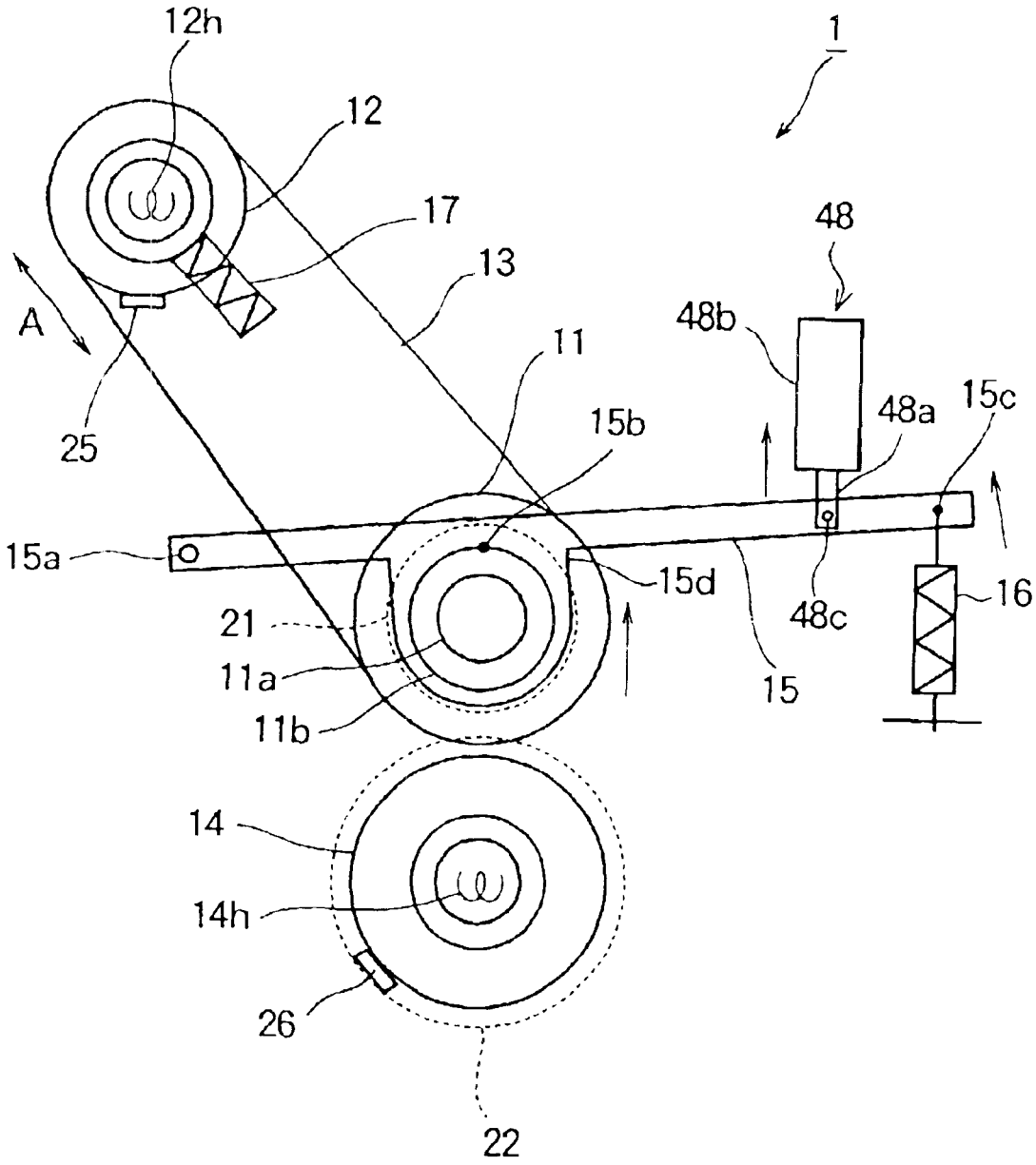
FIG. 22 is a side view illustrating the operation of the fixing device according to Embodiment 4 of the present invention.

FIG. 22 is a side view of the fixing device 1 when the solenoid 48 is in the ON state. When the solenoid 48 is turned ON, the plunger 48*a* moves upward, and pulls the swing lever 15 upward overcoming the force of the lever urging spring 16, so that the fixing roller 11 shifts in the direction away from the pressure roller 14. As the fixing roller 11 shifts upward, the tension applied to the endless belt 13 decreases as was described in Embodiment 1. In this state, the endless belt 13 is applied the tension T2 (FIG. 8) in such a range that the impression is not formed on the endless belt 13 by the contact with the fixing roller 11 and the like, and that the endless belt 13 does not slip over the fixing roller 11.

Figure 23:
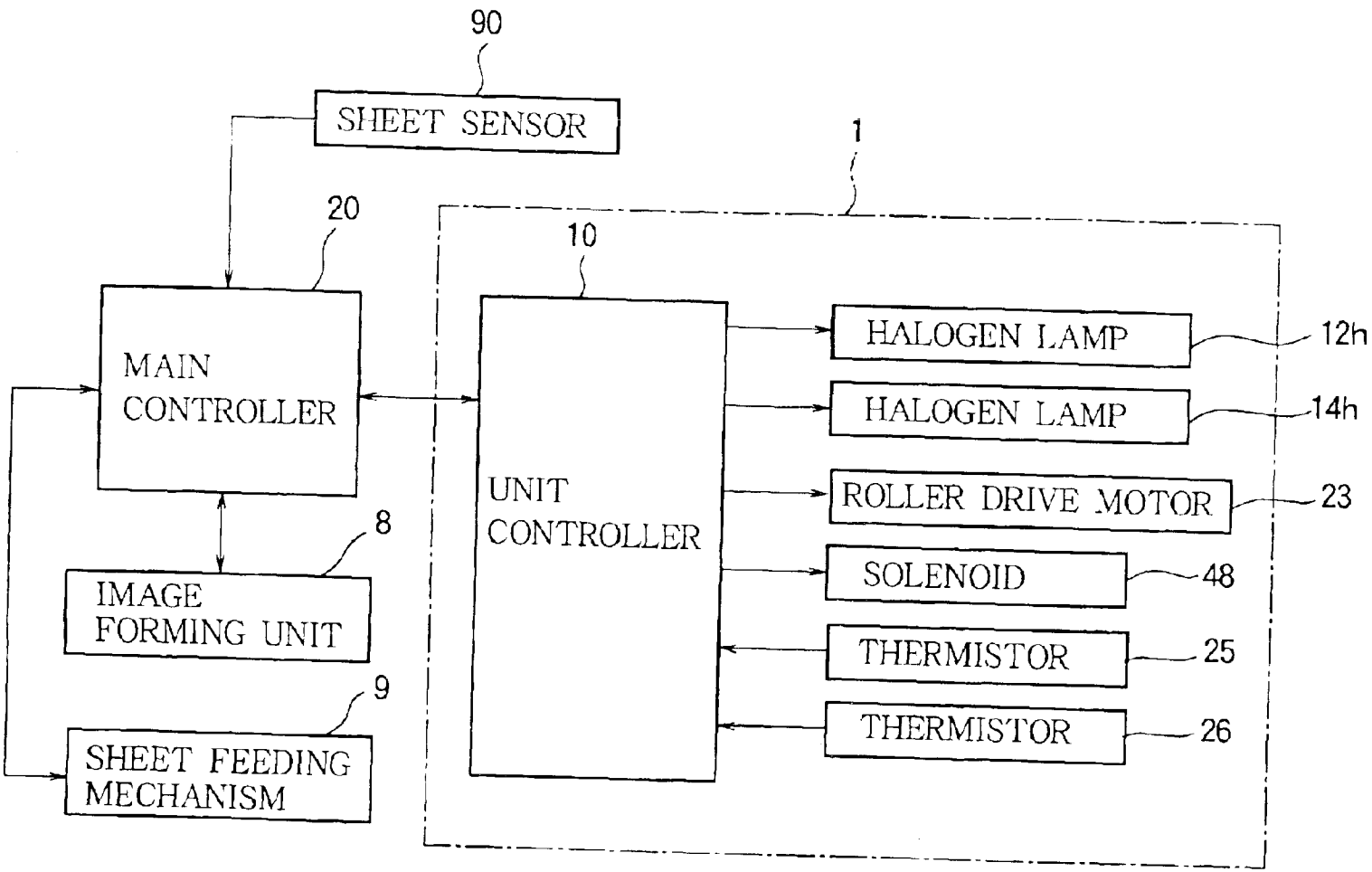
FIG. 23 is a block diagram illustrating a control system of the image forming apparatus including the fixing device according to Embodiment 4 of the present invention.

FIG. 23 is a block diagram illustrating a control system of the image forming apparatus including the fixing device 1 according to Embodiment 4. The unit controller 10 drives the solenoid 48, instead of the cam drive motor 24 (FIG. 2) for rotating the cam 18 in Embodiment 1. The other components of Embodiment 4 are the same as those of Embodiment 1.

The operation of the image forming apparatus according to Embodiment 4 is the same as that of Embodiment 1 except that the solenoid 48 is turned ON when the fixing roller 11 is to be separated from the pressure roller 14, and the solenoid 48 is turned OFF when the fixing roller 11 is to be pressed against the pressure roller 14 via the endless belt 13.

As described above, according to Embodiment 4, because the solenoid 48 has the characteristics of quick response, the fixing roller 11 can be quickly pressed against the pressure roller 14 via the endless belt 13, and the fixing roller 11 can be quickly separated from the pressure roller 14, in addition to the advantages of Embodiment 1.

Embodiment 5

Figure 24:
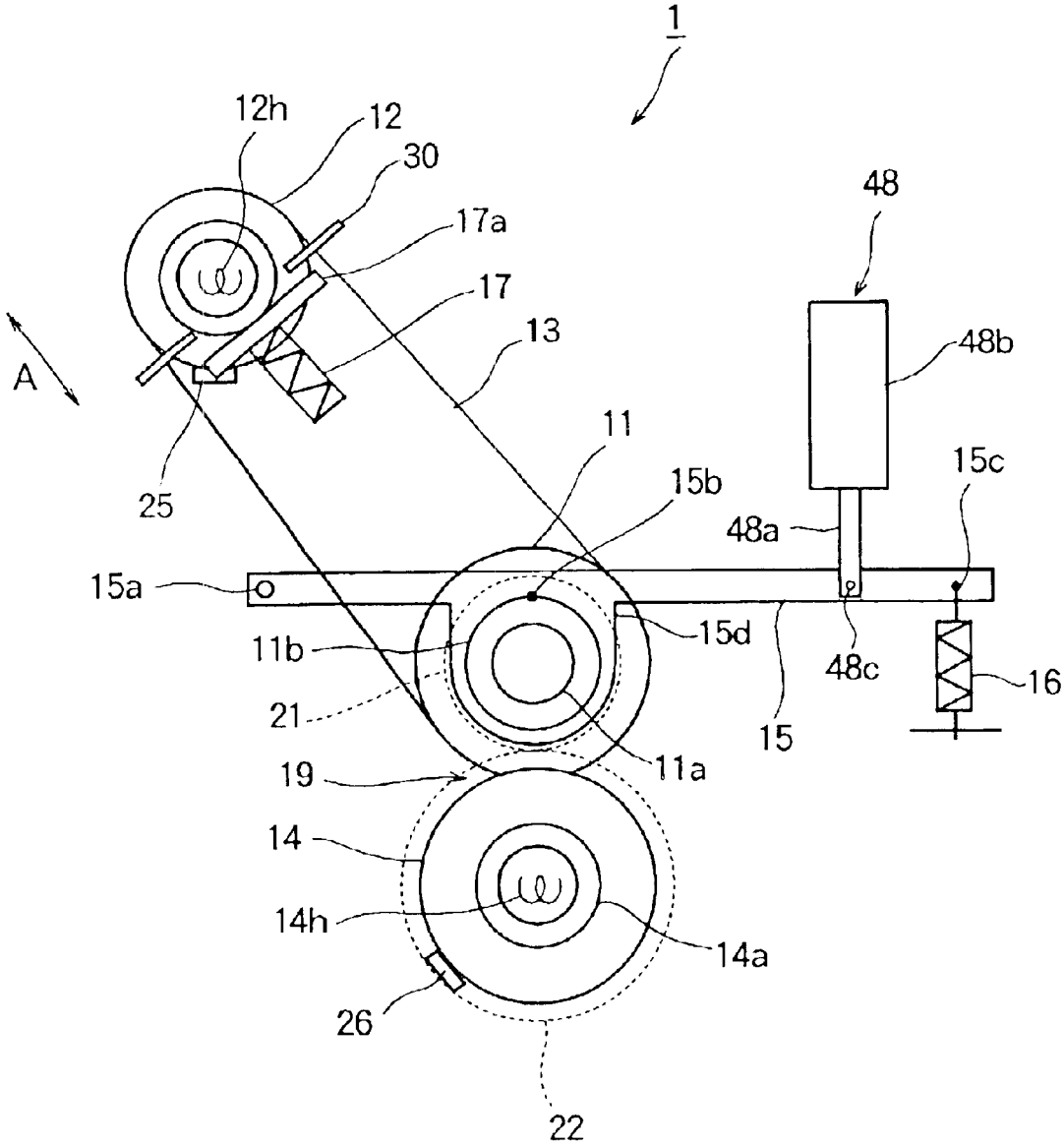
FIG. 24 is a side view of the fixing device according to Embodiment 5 of the present invention.

FIG. 24 is a side view of the fixing device 1 according to Embodiment 5. In Embodiment 5, the solenoid 48 described in Embodiment 4 replaces the cam 18 in Embodiment 2. The other components of Embodiment 5 are the same as those of Embodiment 2.

When the solenoid 48 is in the OFF state, i.e., when no force is applied to the plunger 48*a*, the swing lever 15 is not pulled by the solenoid 48. Therefore, the swing lever 15 is urged downward by the force of the lever urging spring 16, so that the fixing roller 11 is pressed against the pressure roller 14 via the endless belt 13. By means of the tension applying spring 17, the endless belt 13 is applied the tension T1 in such a range that the endless belt 13 does not slip over the fixing roller 11 during the image fixing operation.

Figure 25:
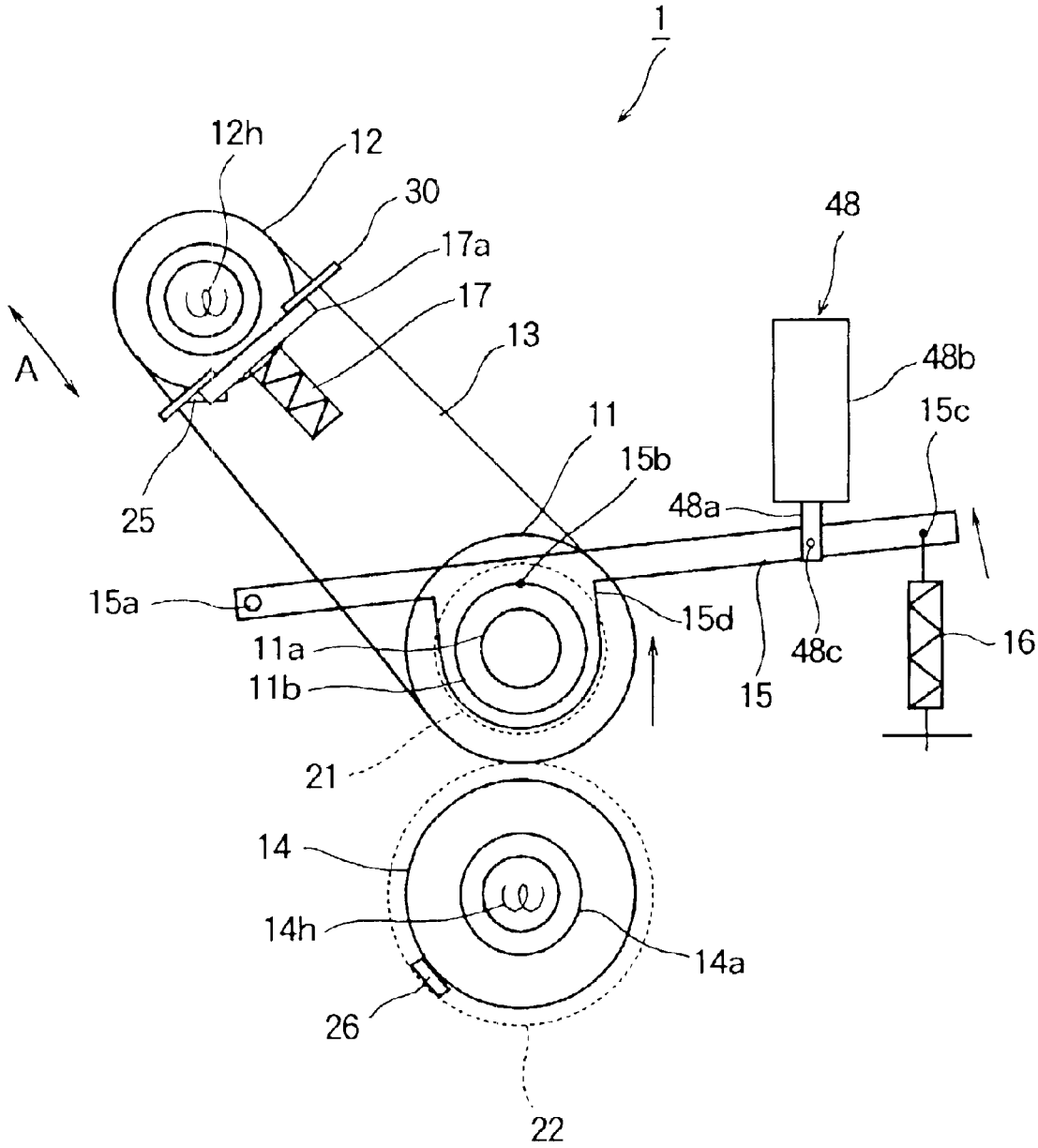
FIG. 25 is a side view illustrating the operation of the fixing device according to Embodiment 5 of the present invention.

FIG. 25 is a side view of the fixing device 1 when the solenoid 48 is in the ON state. When the solenoid 48 is turned ON, the plunger 48*a* moves upward and pulls the swing lever 15 upward, so that the fixing roller 11 shifts in the direction away from the pressure roller 14. When the fixing roller 11 shifts upward, the contact member 17*a* of the tension applying spring 17 abuts against the stopper 30 as was described in Embodiment 2. No tension is applied to the endless belt 13, and therefore the endless belt 13 slackens. The control system of the image forming apparatus of Embodiment 5 is the same as that of Embodiment 4 (FIG. 23).

The operation of the image forming apparatus according to Embodiment 5 is the same as that of Embodiment 2 except that the solenoid 48 is turned ON when the fixing roller 11 is to be separated from the pressure roller 14 and that the solenoid 48 is turned OFF when the fixing roller 11 is to be pressed against the pressure roller 14 via the endless belt 13.

As described above, according to Embodiment 5, because the solenoid 48 has the characteristics of quick response, the fixing roller 11 can be quickly pressed against the pressure roller 14 via the endless belt 13, and the fixing roller 11 can be quickly separated from the pressure roller 14, in addition to the advantages of Embodiment 2.

Embodiment 6

Figure 26:
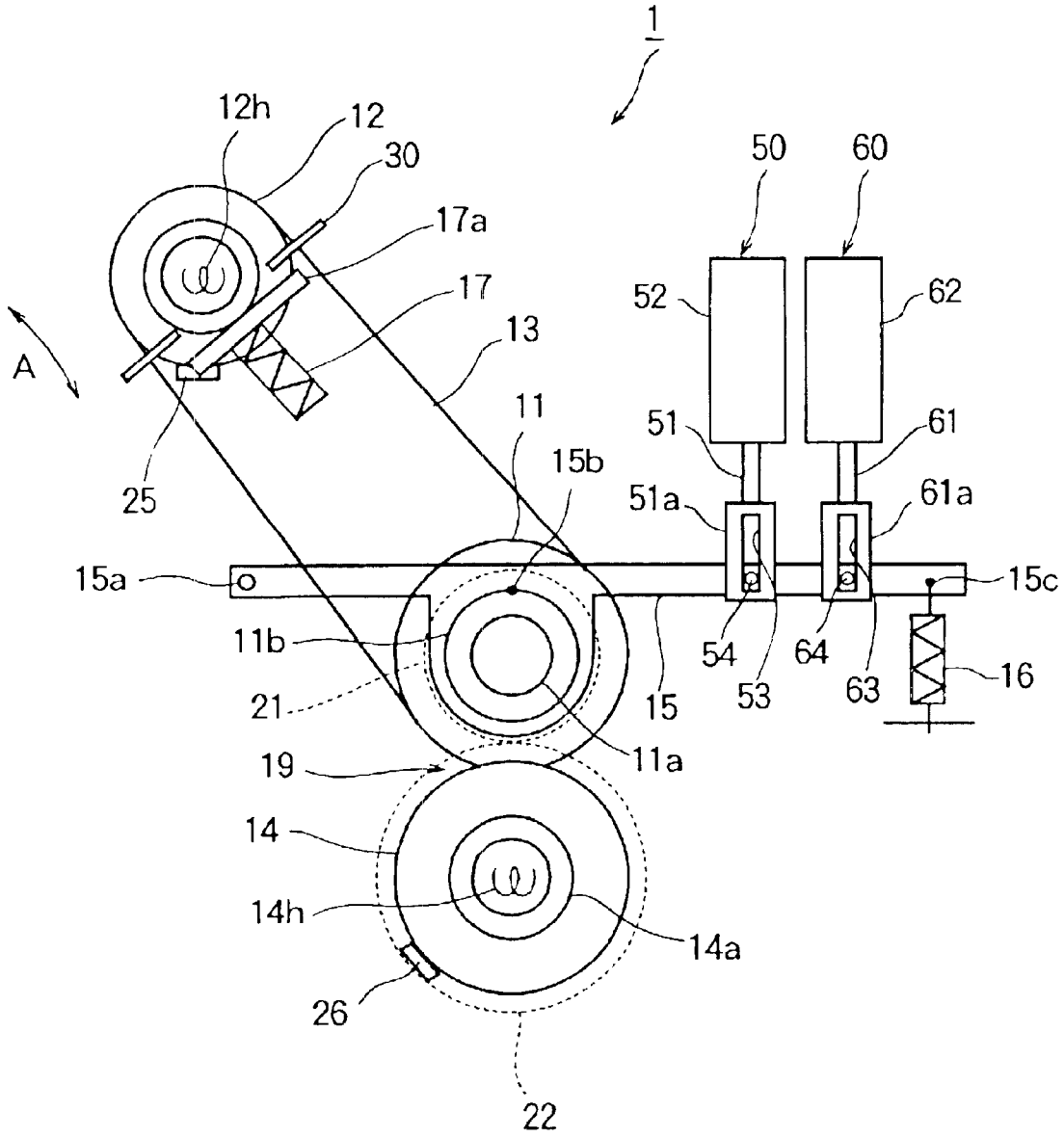
FIG. 26 is a side view of the fixing device according to Embodiment 6 of the present invention.

FIG. 26 is a side view of the fixing device 1 according to Embodiment 6. The fixing device 1 according to Embodiment 6 includes solenoids 50 and 60 connected to the swing lever 15. The solenoids 50 and 60 are provided for selecting the amount by which the swing lever 15 swings upward, so that the fixing roller 11 (as well as the endless belt 13) can have one of two positions at different distances from the pressure roller 14.

The solenoids 50 and 60 respectively have bodies 52 and 62. Vertically movable plungers 51 and 61 are respectively protruded downward from the bottom ends of the bodies 52 and 62. The plungers 51 and 61 respectively have connecting portions 51*a* and 61*a* at the bottom ends thereof. Vertically extending slits 53 and 63 are formed in the connecting portions 51*a* and 61*a*. Pins 54 and 64 are formed on the swing lever 15, and slidably engage the slits 53 and 63. The pins 54 and 64 are arranged along the longitudinal direction of the swing lever 15 between the roller action point 15*b* and the spring action point 15*c*. The pin 54 is a located at a side closer to the roller action point 15*b*, and the pin 64 is located at the other side closer to the spring action point 15*c*.

In the solenoid 50, when an electric current flows through a coil in the body 52 (i.e., in an ON state), an upward driving force is applied to the plunger 51. When no electric current flows through the coil in the body 52 (i.e., in an OFF state), no driving force is applied to the plunger 51. The solenoid 60 is constituted in a similar manner to the solenoid 50.

As shown in FIG. 26, when the solenoids 50 and 60 are both in the OFF states, the swing lever 15 is not pulled by the solenoids 50 and 60, and therefore the swing lever 15 is swung downward by the force of the lever urging spring 16, so that the fixing roller 11 is pressed against the pressure roller 14 via the endless belt 13. By means of the tension applying spring 17, the endless belt 13 is applied the tension T1 (FIG. 8) in such a range that the endless belt 13 does not slip over the fixing roller 11 during the image fixing operation. The pitch circles of the gears 21 and 22 of the fixing roller 11 and the pressure roller 14 contact each other.

Figure 27:
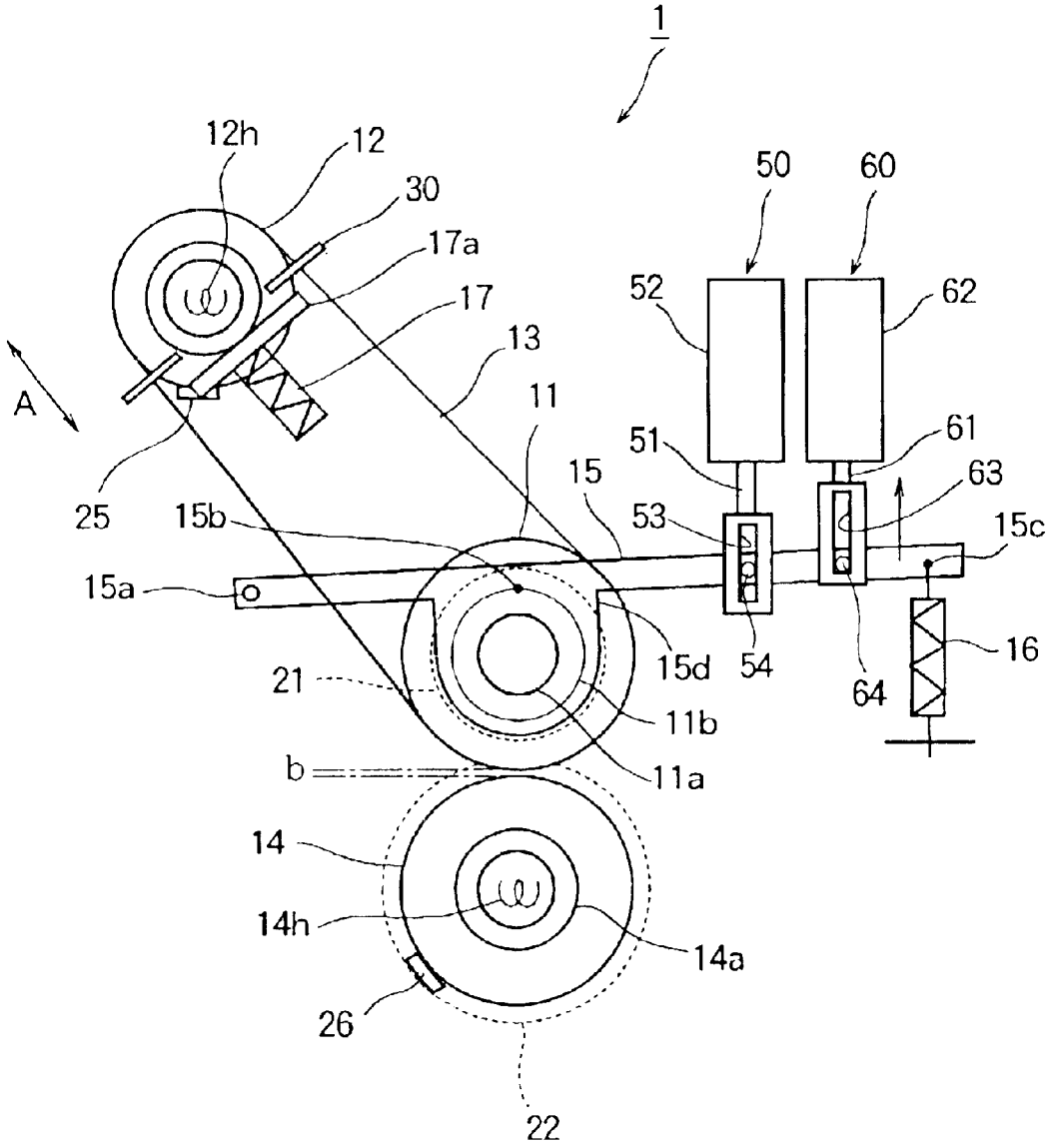
FIG. 27 is a side view illustrating the first step of the operation of the fixing device according to Embodiment 6 of the present invention.
Figure 28:
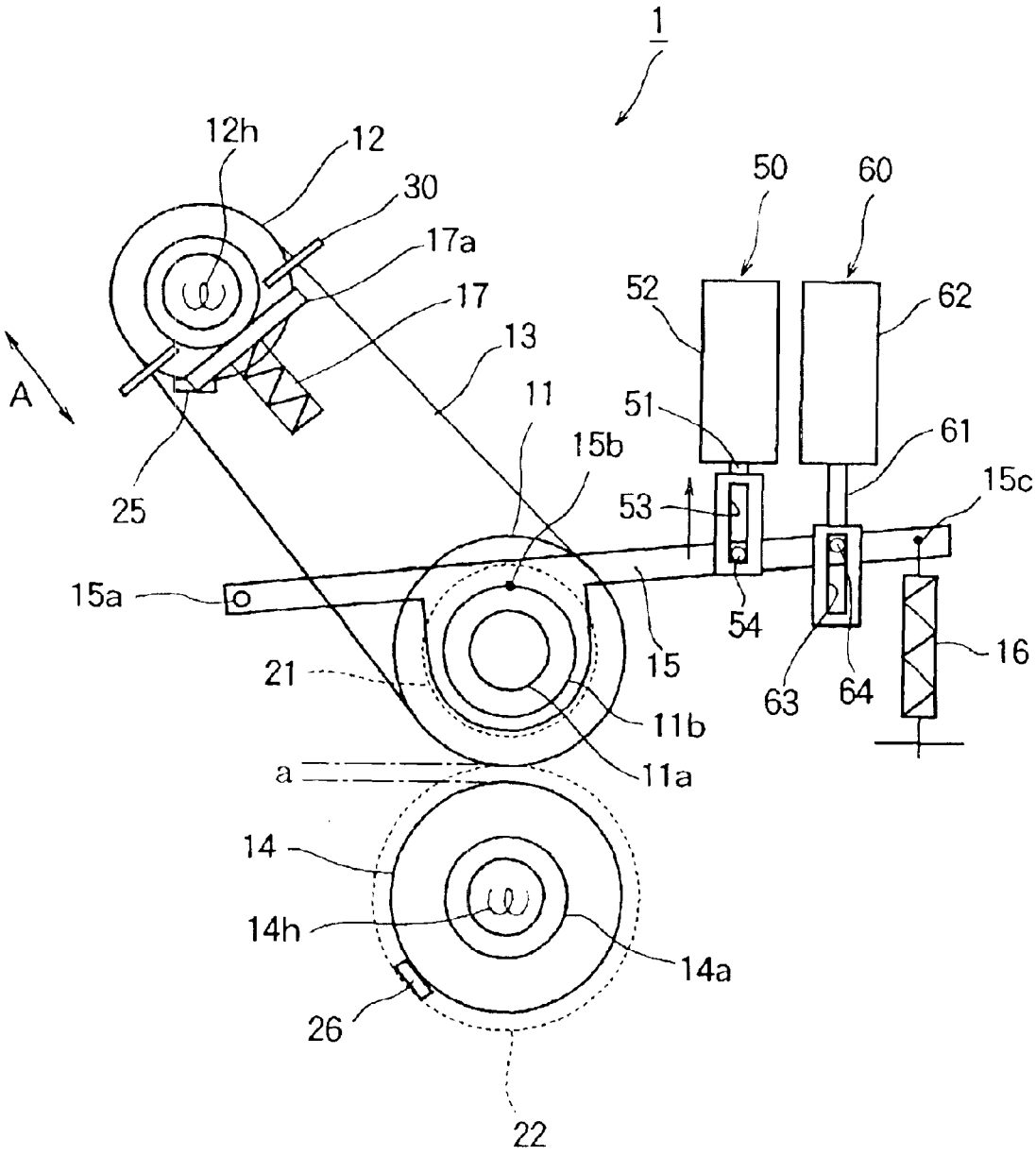
FIG. 28 is a side view illustrating the second step of the operation of the fixing device according to Embodiment 6 of the present invention.

FIG. 27 is a side view illustrating the fixing device 1 when the solenoids 60 is turned ON from the state shown in FIG. 26. FIG. 28 is a side view illustrating the fixing device 1 when the solenoids 50 is turned ON from the state shown in FIG. 26. As shown in FIG. 27, when the solenoid 60 is turned ON while the solenoid 50 remains OFF, the bottom end of the slit 63 of the solenoid 60 abuts against the pin 64 from below so that the swing lever 15 swings upward overcoming the force of the lever urging spring 16. The other pin 54 does not abut against the bottom end or the top end of the slit 53 of the solenoid 50. In this state, the gap "b"

is formed between the endless belt 13 and the pressure roller 14. As the fixing roller 11 shifts upward, the length of the tension applying spring 17 increases, so that the tension applied to the endless belt 13 decreases. The contact member 17*a* of the tension applying spring 17 does not contact the stopper 30. The endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like. The gears 21 and 22 are able to transmit the rotation to each other.

As shown in FIG. 28, when the solenoid 50 is turned ON while the solenoid 60 remains OFF, the bottom end of the slit 53 of the solenoid 50 abuts against the pin 54 from below so that the swing lever 15 swings upward. The other pin 64 does not abut against the bottom end or the top end of the slit 63 of the solenoid 60. As described above, the pin 54 of the solenoid 50 is located to a side closer to the fulcrum 15*a* compared with the pin 64 of the solenoid 60. Thus, the swinging amount of the swing lever 15 is greater when the solenoid 50 is turned ON than when the solenoid 60 is turned ON (FIG. 27). Thus, the gap "a" between the endless belt 13 and the pressure roller 14 is greater than the gap "b" (FIG. 27). The contact member 17*a* of the tension applying spring 17 abuts against the stopper 30, so that no tension is applied to the endless belt 13 and therefore the endless belt 13 slackens. Although it is possible that gears 21 and 22 separate from each other, it is preferable that the addendum circles H1 and H2 of the gears 21 and 22 intersect each other as shown in FIG. 6B, in order to prevent the tooth top portions of the gears 21 and 22 from abutting each other when the gears 21 and 22 mesh each other.

The fixing roller 11 and the heating roller 12 are provided with the position regulating rings 32 for preventing the deviation of the endless belt 13 with respect to the fixing roller 11 and the like when the endless belt 13 slackens.

Figure 29:
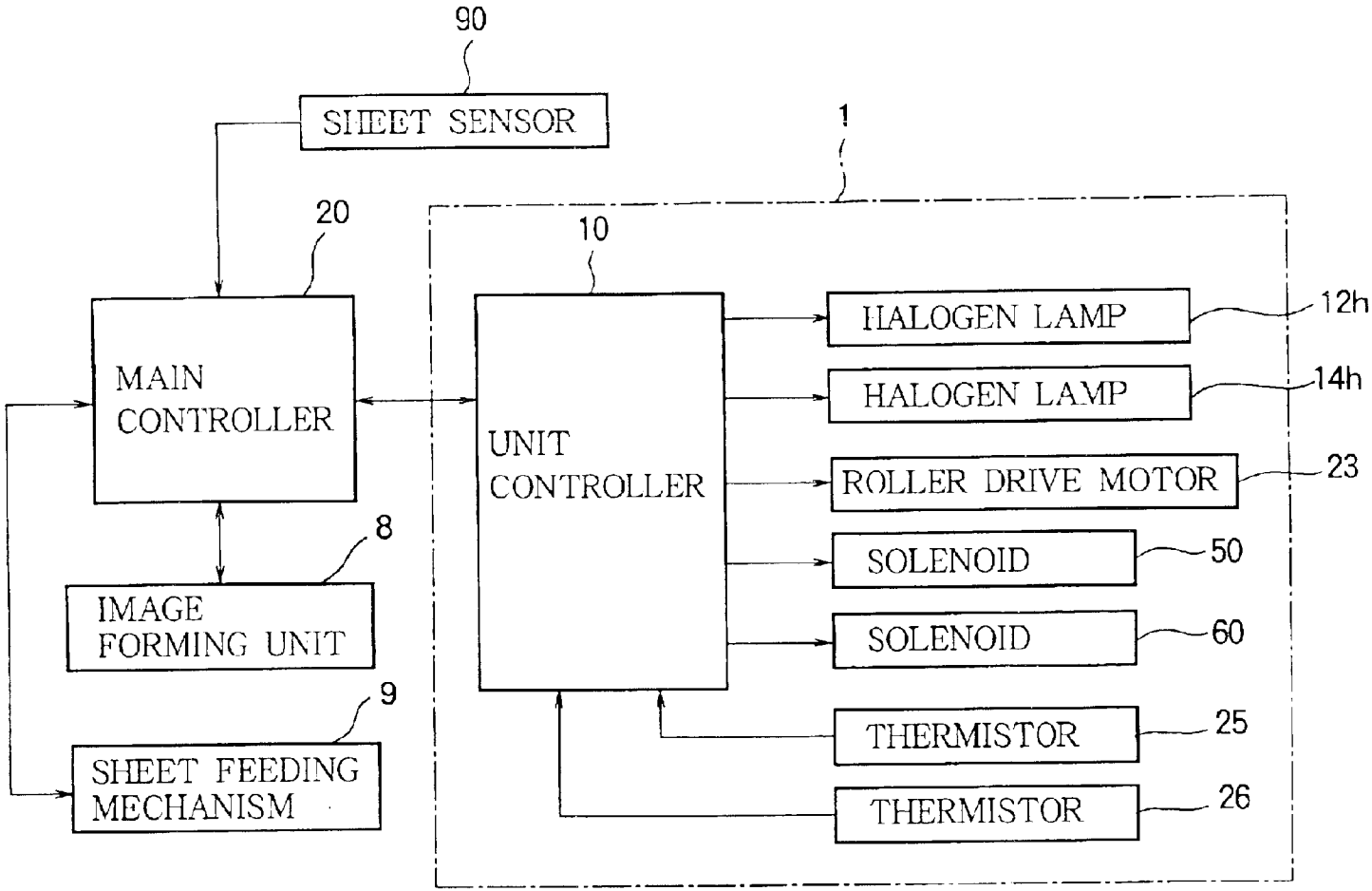
FIG. 29 is a block diagram of a control system of the image forming apparatus including the fixing device according to Embodiment 6 of the present invention.

FIG. 29 is a block diagram illustrating the control system of the image forming apparatus including the fixing device 1 according to Embodiment 6. The unit controller 10 of the fixing device 1 drives the solenoids 50 and 60, instead of the cam drive motor 24 for rotating the cam 18 (FIG. 1) in Embodiment 1. The other components are the same as those of Embodiment 1.

The operation of the image forming apparatus will be described. As shown in FIG. 28, in the standby state, the solenoid 50 is turned ON and the solenoid 60 is turned OFF. The fixing roller 11 and the endless belt 13 are apart from the pressure roller 14. The gap "a" is formed between the endless belt 13 and the fixing roller 11, and therefore the endless belt 13 slackens.

When the job of the image forming unit 8 is generated, or when the main controller 20 determines it necessary to heat the heating roller 12 and the pressure roller 14 to keep their temperatures, the main controller 20 instructs the unit controller 10 to perform the warm-up operation. The unit controller 10 turns ON the solenoid 60 and turns OFF the solenoid 50, according to the instruction from the main controller 20. The swing lever 15 swings downward, so that the gap "b" is formed between the endless belt 13 and the pressure roller 14 as shown in FIG. 27. In this state, the endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like. Further, the gears 21 and 22 are in such relative positions that the gears 21 and 22 are able to transmit the rotation to each other.

The unit controller 10 starts the rotation of the roller drive motor 23. When the roller drive motor 23 rotates the pressure roller 14, the rotation of the pressure roller 14 is transmitted to the fixing roller 11 through the gears 21 and 22, so that the endless belt 13 moves and the heating roller 12 rotates. The unit controller 10 further drives the halogen lamps 12*h* and 14*h*. The fixing roller 11, the heating roller 12, the endless belt 13 and the pressure roller 14 are uniformly heated.

The main controller 20 calculates the time when the front end of the recording sheet reaches the nip portion 19 according to the detection signal from the sheet sensor 90, and instructs the unit controller 10 to close the nip portion 19 when the recording sheet reaches the nip portion 19. According to the instruction from the main controller 20, the unit controller 10 turns OFF the solenoids 50 and 60. The swing lever 15 is not pulled by the solenoids 50 and 60 and is swung downward by the force of the lever urging spring 16. As a result, as shown in FIG. 26, the fixing roller 11 is pressed against the pressure roller 14 via the endless belt 13. The endless belt 13 is applied the tension T1 (FIG. 8) in such a range that the endless belt 13 does not slip over the fixing roller 11 during the image fixing operation. Then, the toner image is fixed to the recording sheet in the nip portion 19 between the endless belt 13 and the pressure roller 14, as was described in Embodiment 1.

The main controller 20 calculates the time when the rear end of the recording sheet passes through the nip portion 19 according to the detection signal from the sheet sensor 90. The main controller 20 instructs the unit controller 10 to open the nip portion 19 when the rear end of the recording sheet passes through the nip portion 19. The unit controller 10 turns ON the solenoid 50 while the solenoid 60 remains OFF. The solenoid 50 pulls the swing lever 15 upward, so that the gap "a" is formed between the endless belt 13 and the pressure roller 14 as shown in FIG. 28. The unit controller 10 stops the rotation of the roller drive motor 23 and stops the power supply to the halogen lamps 12*h* and 14*h*. As the contact member 17*a* of the tension applying spring 17 abuts against the stopper 30, the endless belt 13 slackens.

During the above described image fixing operation, when the main controller 20 detects the jam of the recording sheet based on the signal from the sheet sensor 90 or the like, the main controller 20 instructs the unit controller 10 to open the nip portion 19. Consequently, the fixing roller 11 and the endless belt 13 separate from the pressure roller 14, and therefore the jammed recording sheet can be easily removed.

As described above, according to Embodiment 6, because the solenoids 50 and 60 have the characteristics of quick response, the fixing roller 11 can be quickly pressed against the pressure roller 14 via the endless belt 13, and the fixing roller 11 can be quickly separated from the pressure roller 14, in addition to the advantages of Embodiment 3.

Embodiment 7

Figure 30:
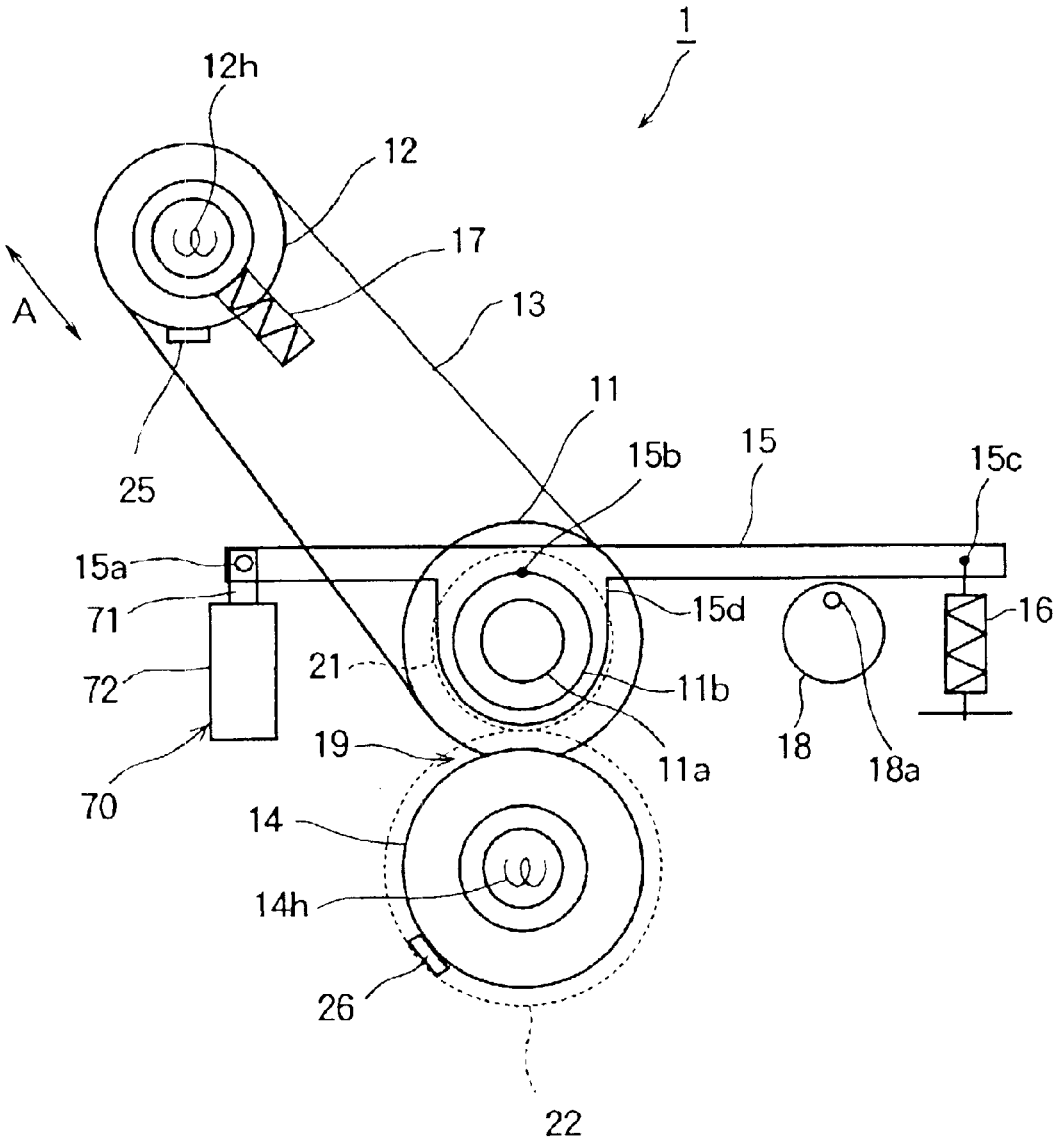
FIG. 30 is a side view of the fixing device according to Embodiment 7 of the present invention.

FIG. 30 is a side view of the fixing device 1 according to Embodiment 7. In Embodiment 7, the fulcrum 15*a* of the swing lever 15 is supported by a plunger 71 of a solenoid 70. The solenoid (i.e., an urging force varying mechanism) 70 includes a body 72 disposed below the fulcrum 15*a* of the swing lever 15, and the vertically movable plunger 71 protruded upward from the body 72. The fulcrum 15*a* is defined by a pin mounted to the top of the plunger 71.

When an electric current flows through a coil in the body 72 of the solenoid 70, a downward driving force is applied to the plunger 71, so that the plunger 71 is held at its lowest position. When no electric current flows through the coil in the body 72, no force is applied to the plunger 71, so that the plunger 71 is able to move in the vertical direction. The cam 18 is located between the roller action point 15*b* and the spring action point 15*c*. The cam 18 has the same structure as that of Embodiment 1, and is able to contact the swing lever 15. The cam 18 rotates about its rotation axis 18*a* so as to push the swing lever 15 upward.

As shown in FIG. 30, when the cam 18 does not abut against the swing lever 15 and the solenoid 70 is in the ON state (i.e., when the plunger 71 is at its lowest position), the swing lever 15 acts as if the fulcrum 15*a* is fixed to a stationary part. Thus, the swing lever 15 swings downward by the force of the lever urging spring 16, with the result that the fixing roller 11 is pressed against the pressure roller 14 via the endless belt 13. Further, the endless belt 13 is applied the tension T1 (FIG. 8) in such a range that the endless belt 13 does not slip over the fixing roller 11 during the image fixing operation.

Figure 31:
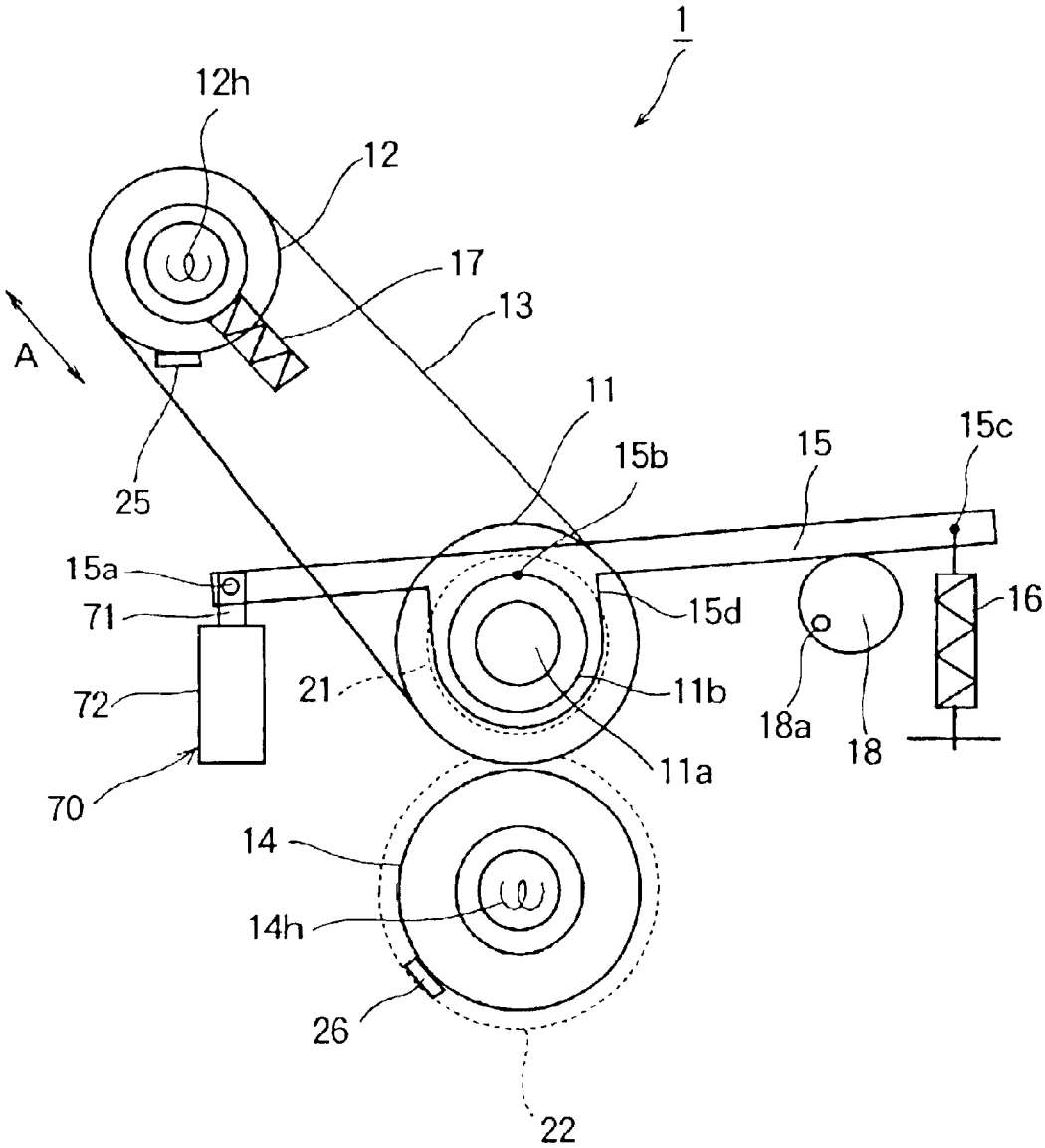
FIG. 31 is a side view illustrating the first step of the operation of the fixing device according to Embodiment 7 of the present invention.
Figure 32:
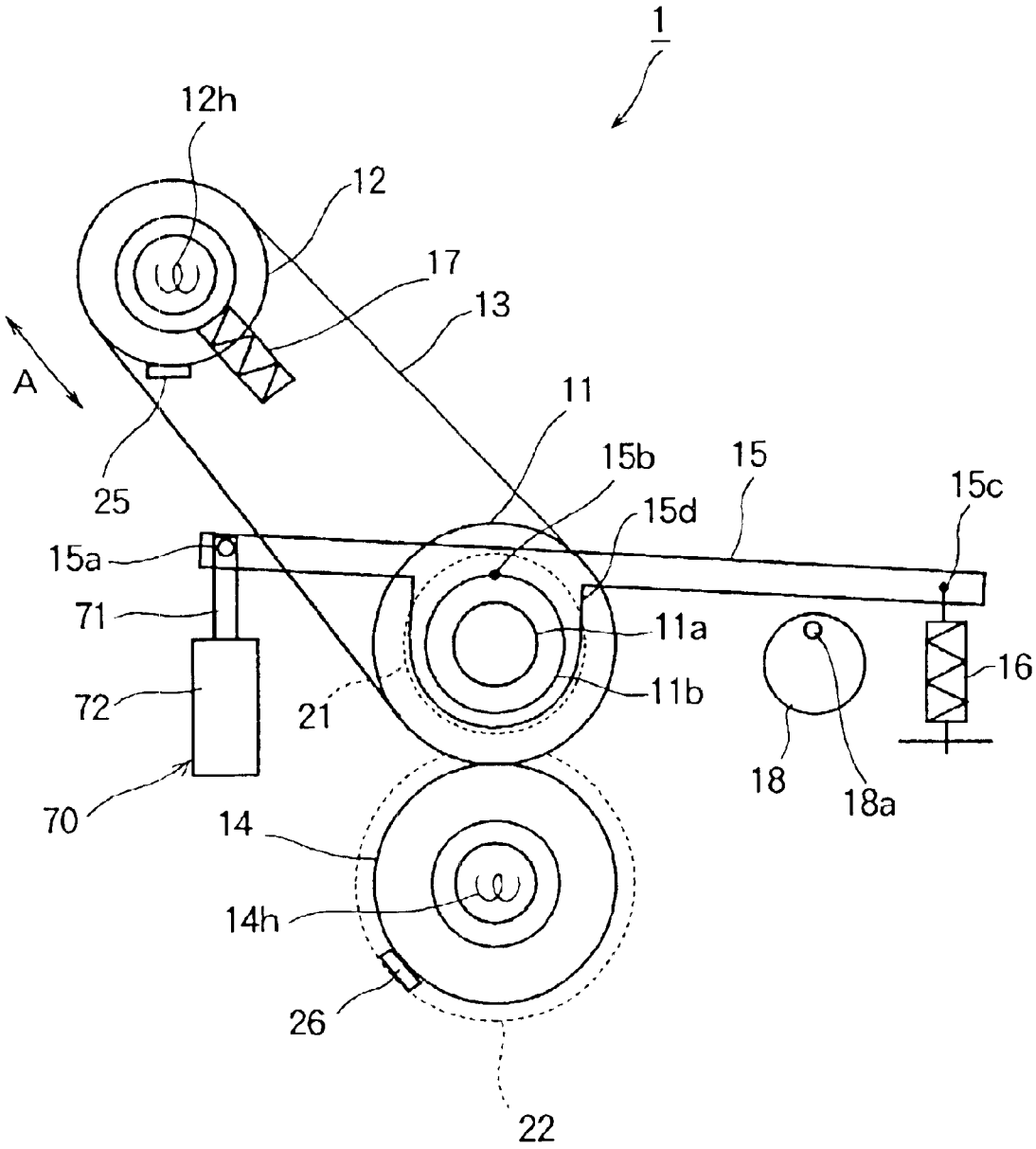
FIG. 32 is a side view illustrating the second step of the operation of the fixing device according to Embodiment 7 of the present invention.

FIG. 31 is a side view illustrating the fixing device 1 when the cam 18 is driven from the state shown in FIG. 30. FIG. 32 is a side view illustrating the fixing device 1 when the solenoid 70 is turned OFF from the state shown in FIG. 30. When the cam 18 rotates and pushes the swing lever 15 upward from the state shown in FIG. 30 while the solenoid 70 remains ON, the fixing roller 11 and the endless belt 13 separate from the pressure roller 14 as shown in FIG. 31. As the fixing roller 11 shifts upward, the heating roller 12 shifts in the direction away from the fixing roller 11, so that the length of the tension applying spring 17 increases and therefore the tension applied to the endless belt 13 decreases. The endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like. Although the pitch circles of the gears 21 and 22 of the pressure roller 14 are apart from each other, the addendum circles of the gears 21 and 22 intersect each other. In other word, the gears 21 and 22 are in such relative positions that the gears 21 and 22 are able to transmit the rotation to each other, by means of the contact between the tooth top portions of the gears 21 and 22.

Conversely, when the solenoid 70 is turned OFF from the state shown in FIG. 30, the plunger 71 becomes movable in the vertical direction, with the result that the fulcrum 15*a* becomes movable in the vertical direction. In this state, the fixing roller 11 shifts upward due to the elastic recovery, because the fixing roller 11 has been deformed by being pressed against the pressure roller 14. As the fixing roller 11 shifts upward, the plunger 71 also moves upward, so that the swing lever 15 swings upward substantially about the spring action point 15*c*. As a result, the fixing roller 11 is not pressed against the pressure roller 14 but simply placed on the pressure roller 14 via the endless belt 13. Further, as the fixing roller 11 shifts upward, the heating roller 12 shifts in the direction away from the fixing roller 11 so that the length of the tension applying spring 17 increases, with the result that the tension applied to the endless belt 13 decreases. The endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like. The tension applied to the endless belt 13 is determined according to spring constants and dimensions of the tension applying spring 17 and the lever urging spring 16, and the protruding amount of the plunger 71.

Figure 33:
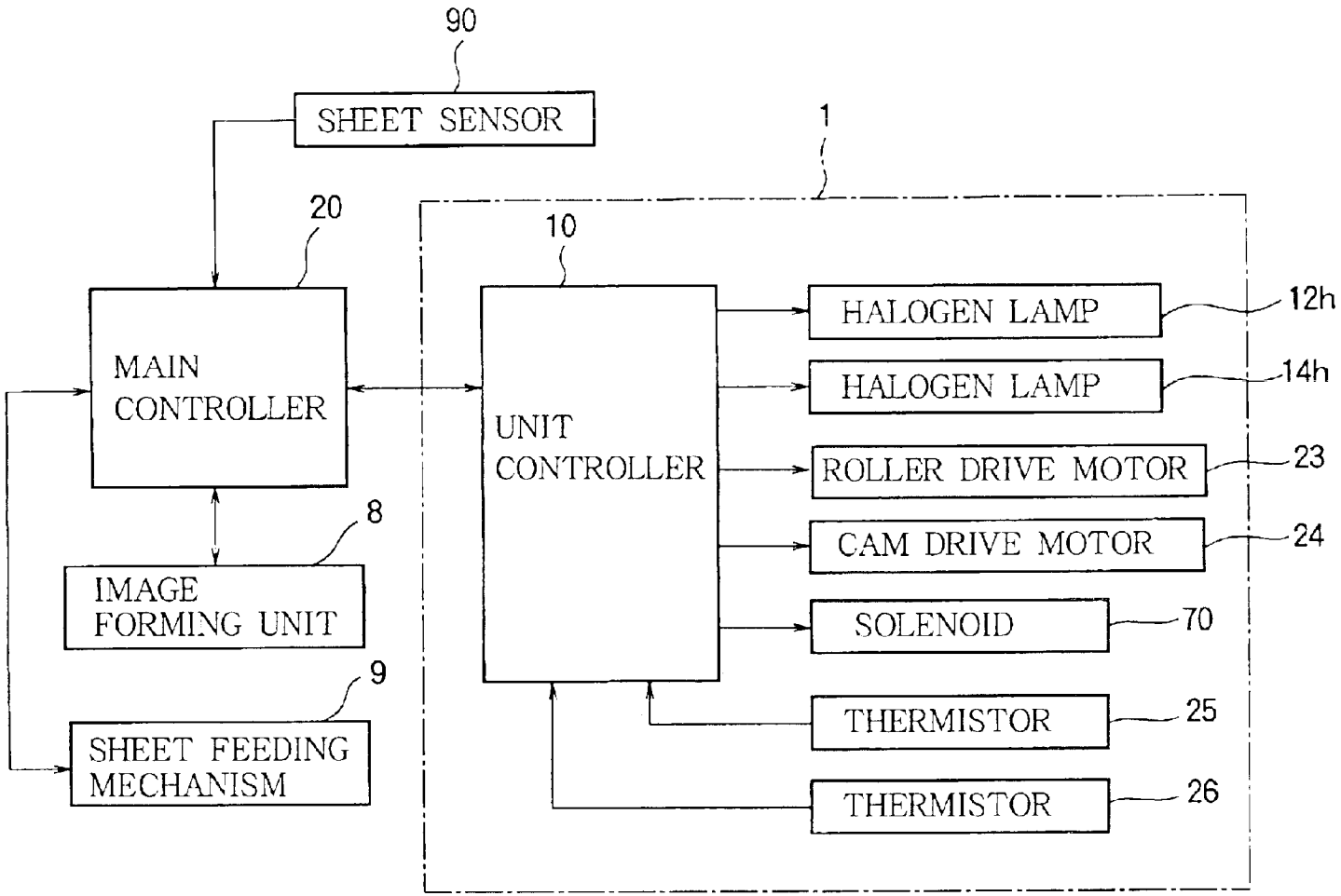
FIG. 33 is a block diagram of a control system of the image forming apparatus including the fixing device according to Embodiment 7 of the present invention.

FIG. 33 is a block diagram illustrating the control system of the image forming apparatus including the fixing device 1 according to Embodiment 7. In the control system, the unit controller 10 drives the solenoid 70, as well as the halogen lamps 12*h* and 14*h* and the roller drive motor 23. The unit controller 10 receives data from the thermistors 25 and 26. Further, the unit controller 10 receives the detection signal from the sheet sensor 90 when the sheet sensor 90 detects the passage of the front end or the rear end of the recording sheet.

The operation of the image forming apparatus will be described. As shown in FIG. 31, in the standby state, the solenoid 70 is in the ON state and the cam 18 lifts the swing lever 15, so that the fixing roller 11 and the endless belt 13 separate from the pressure roller 14. Further, the endless belt 13 is applied the tension T2 (FIG. 8) in such a range that the impression is not formed on the endless belt 13 by the contact with the fixing roller 11 and the like, and that the endless belt 13 does not slip over the fixing roller 11 and the like.

When the job of the image forming unit 8 is generated, or when the main controller 20 determines it necessary to heat the heating roller 12 and the pressure roller 14 to keep their temperatures, the main controller 20 instructs the unit controller 10 to perform the warm-up operation. The unit controller 10 drives the roller driving motor 23 while the solenoid 70 remains ON, so that the fixing roller 11, the heating roller 12 and the pressure roller 14 start rotating and the endless belt 13 starts moving. The unit controller 10 further drives the halogen lamps 12*h* and 14*h*.

The main controller 20 calculates the time when the front end of the recording sheet reaches the nip portion 19 according to the detection signal from the sheet sensor 90, and instructs the unit controller 10 to close the nip portion 19 when the recording sheet reaches the nip portion 19. According to the instruction from the main controller 20, the unit controller 10 drives the cam drive motor 24 while the solenoid 70 remains ON, so that the cam 18 rotates by a predetermined angle and separates from the swing lever 15. The swing lever 15 is swung downward by the force of the lever urging spring 16, so that the fixing roller 11 is pressed against the pressure roller 14 as shown in FIG. 30. As the fixing roller 11 shifts downward, the heating roller 12 also shifts downward so that the tension applying spring 17 is compressed. In this state, by means of the tension applying spring 17, the endless belt 13 is applied the tension T1 (FIG. 8) in such a range that the endless belt 13 does not slip over the fixing roller 11 during the image fixing operation. Then, the toner image is fixed to the recording sheet in the nip portion 19 between the endless belt 13 and the pressure roller 14, as was described in Embodiment 1.

The main controller 20 calculates the time when the rear end of the recording sheet passes through the nip portion 19 according to the detection signal from the sheet sensor 90. The main controller 20 instructs the unit controller 10 to open the nip portion 19 when the rear end of the recording sheet passes through the nip portion 19. The unit controller 10 drives the cam drive motor 24, so that the cam 18 rotates by a predetermined angle. The cam 18 pushes the swing lever 15 upward overcoming the force of the lever urging spring 16. As a result, the fixing roller 11 and the endless belt 13 separate from the pressure roller 14 as shown in FIG. 31. The unit controller 10 stops the rotation of the roller drive motor 23 and stops the power supply to the halogen lamps 12*h* and 14*h*.

During the above described image fixing operation, there is a possibility that the power supply to the image forming apparatus is mistakenly turned off, or a power outage occurs. In such a case, an electric current does not flow in the coil of the solenoid 70, so that no driving force is applied to the plunger 71, and therefore the plunger 71 becomes movable in the vertical direction. As a result, the fixing roller 11 shifts upward, due to the elastic recovery of the fixing roller 11 that has been deformed by being pressed against the pressure roller 14. Therefore, the swing lever 15 swings upward substantially about the spring action point 15*c*. As the fixing roller 11 shifts upward, the tension applied to the endless belt 13 decreases, so that the endless belt 13 is applied the tension in such a range that the impression is not formed on the endless belt 13 even if the endless belt 13 contacts the fixing roller 11 and the like for a long time.

As described above, in Embodiment 7, if the power supply is turned off or if the power outage occurs during the image fixing operation, the solenoid 70 is turned OFF and therefore the force pressing the fixing roller 11 against the pressure roller 14 decreases. As a result, it is possible to prevent the fixing roller 11 from being pressed against the pressure roller 14 via the endless belt 13 for a long time. Accordingly, the lifetimes of the endless belt 13 and the rollers 11, 12 and 14 can be lengthened.

In above described Embodiments 1 through 3 and 7, the cams 18 and 38 are driven by the roller drive motor 23. However, the cams 18 and 38 can be driven by means of gears for rotating the fixing roller 11 or the pressure roller 14. In this case, the cams 18 and 38 can be driven by the rotation of the fixing roller 11 or the pressure roller 14 in the directions opposite to the direction during the image fixing operation, by means of an one-way clutch or the like.

Further, in above described Embodiment 7, the fulcrum 15*a* of the swing lever 15 is mounted to the solenoid 70 in the fixing device 1 according to Embodiment 1. However, the arrangement that the fulcrum 15*a* of the swing lever 15 is mounted the solenoid 70 can be adapted to any of the fixing devices 1 according to Embodiments 2 through 6.

Moreover, in Embodiments 1 through 7, the endless belt 13 is stretched around two rollers (the fixing roller 11 and the heating roller 12). However, the endless belt 13 can be stretched around a group or rollers including three or more rollers. In this case, the fixing roller and another roller in the group must have a relationship as that of the fixing roller 11 and the heating roller 12.

While the preferred embodiments of the present invention have been illustrated in detail, it should be apparent that modifications and improvements may be made to the invention without departing from the spirit and scope of the invention as described in the following claims.

What is claimed is:

1. A fixing device comprising:

a group of rollers including at least one roller having a heat source, said group of rollers further including a first roller having no heat source;

an endless belt stretched around said group of rollers;

a second roller facing said first roller via said endless belt so as to form a nip portion between said second roller and said endless belt, said second roller having a heat source;

a tension applying mechanism that applies a tension to said endless belt; and a shifting mechanism that shifts said first roller in the direction away from said second roller, said shifting mechanism shifting said first roller in a direction in which said tension applied to said endless belt decreases, said tension applying mechanism applying said tension to said endless belt in such a range that an impression is not formed on said endless belt and that said endless belt does not slip over said group of rollers, when said first roller is shifted in the direction away from said second roller by said shifting mechanism.

2. The fixing device according to claim 1, wherein said tension applying mechanism applies said tension to said endless belt in such a range that said endless belt does not slip over said group of rollers, when said nip portion is formed between said second roller and said endless belt.

3. The fixing device according to claims 1, wherein said tension applying mechanism comprises:

a supporting mechanism that movably supports said roller having said heat source among said group of rollers in the direction toward and away from said first roller; and a tension applying member that urges said roller having said heat source in the direction away from said first roller.

4. The fixing device according to claim 1, wherein said shifting mechanism comprises:

a roller supporting member that rotatably supports said first roller; and a driving mechanism that drives said roller supporting member in the direction in which said first roller moves toward and away from said second roller.

5. The fixing device according to claim 4, wherein said driving mechanism includes a cam or a solenoid.

6. The fixing device according to claim 1, wherein said first and second rollers respectively have first and second gears that are able to engage each other, and wherein said first and second gears are in such relative positions that tooth top portions of said first and second gears are able to contact each other, so that said first and second gears are able to transmit the rotation to each other, when said first roller is shifted in the direction away from said second roller by said shifting mechanism.

7. An image forming apparatus comprising said fixing device according to claim 1, said image forming apparatus further comprising:

an image forming unit that forms a toner image on a recording sheet, said toner image being fixed to said recording sheet by said fixing device; and a control unit that controls said image forming unit and said fixing device.

8. The image forming apparatus according to claim 7, wherein said control unit rotates at least one of said group of rollers to move said endless belt, and heats said second roller and said roller having said heat source among said group of rollers, when said first roller is shifted away from said second roller by said shifting mechanism.

9. The image forming apparatus according to claim 8, further comprising a detection unit that detects said recording sheet, wherein said control unit drives said shifting mechanism according to a detection signal from said detection unit.

10. A fixing device comprising:

a group of rollers including at least one roller having a heat source, said group of rollers further including a first roller having no heat source;

an endless belt stretched around said group of rollers;

a second roller facing said first roller via said endless belt so as to form a nip portion between said second roller and said endless belt, said second roller having a heat source;

a tension applying mechanism that applies a tension to said endless belt;

a shifting mechanism that shifts said first roller in the direction away from said second roller; and a release mechanism that releases said tension applied to said endless belt by said tension applying mechanism, when said first roller is shifted in the direction away from said second roller by said shifting mechanism.

11. The fixing device according to claim 10, wherein said shifting mechanism is able to shift said first roller to a first position at a distance from said second roller and a second position at a second distance from said second roller, said second distance being greater than said first distance, and wherein said release mechanism releases said tension applied to said endless belt by said tension applying mechanism, when said first roller is shifted to said second position.

12. The fixing device according to claim 10, further comprising a belt regulating mechanism that regulates the position of said endless belt with respect to said group of rollers in the direction of the width of said endless belt.

13. The fixing device according to claim 10, wherein said first and second rollers respectively have first and second gears that are able to engage each other, and tooth top portions of said first and second gears are pointed.

14. An image forming apparatus comprising said fixing device according to claim 10, said image forming apparatus further comprising:

an image forming unit that forms a toner image on a recording sheet, said toner image being fixed to said recording sheet by said fixing device; and a control unit that controls said image forming unit and said fixing device.

15. The image forming apparatus according to claim 14, wherein said control unit rotates at least one of said group of rollers to move said endless belt, and heats said second roller and said roller having said heat source among said group of rollers, when said first roller is shifted away from said second roller by said shifting mechanism.

16. The image forming apparatus according to claim 15, further comprising a detection unit that detects said recording sheet, wherein said control unit drives said shifting mechanism according to a detection signal from said detection unit.

17. The image forming apparatus according to claim 15, wherein said shifting mechanism is able to shift said first roller to a first position at a first distance from said second roller and a second position at a second distance from said second roller, said second distance being greater than said first distance, wherein a release mechanism is provided for releasing said tension applied to said endless belt by said tension applying mechanism, when said first roller is shifted to said second position, and wherein said control unit drives said shifting mechanism to shift said first roller to said second position so that said endless belt slackens, when said control unit has no job to be executed by said image forming unit.

18. The image forming apparatus according to claim 17, wherein said control unit drives said shifting mechanism to shift said first roller to said first position and heats said second roller and said roller having said heat source among said group of rollers, when a job to be executed by said image forming unit is generated, or when said control unit determines it necessary to heat said second roller and said roller having said heat source among said group of rollers.

19. The image forming apparatus according to claim 17, wherein said control unit drives said shifting mechanism to shift said first roller to said second position when said control unit detects a jam of said recording sheet.

20. The fixing device according to claim 10, wherein said shifting mechanism comprises:

a roller supporting member that rotatably supports said first roller; and a driving mechanism that drives said roller supporting member in the direction in which said first roller moves toward and away from said second roller.

21. The fixing device according to claim 20, wherein said driving mechanism includes a cam or a solenoid.

22. The fixing device according to claim 10, wherein said first and second rollers respectively have first and second gears that are able to engage each other, and wherein said first and second gears are in such relative positions that tooth top portions of said first and second gears are able to contact each other, so that said first and second gears are able to transmit the rotation to each other, when said first roller is shifted in the direction away from said second roller by said shifting mechanism.

23. A fixing device comprising:

a group of rollers including at least one roller having a heat source, said group of rollers further including a first roller having no heat source;

an endless belt stretched around said group of rollers;

a second roller facing said first roller via said endless belt so as to form a nip portion between said second roller and said endless belt, said second roller having a heat source;

a shifting mechanism that shifts said first roller in the direction away from said second roller;

an urging mechanism that urges said first roller in a direction toward said second roller via said endless belt; and an urging force varying mechanism that varies an urging force with which said urging mechanism urges said first roller.

24. The fixing device according to claim 23, wherein said urging mechanism comprises a swing lever that supports said first roller, and said urging force varying mechanism changes the position of a fulcrum of said swing lever for varying said urging force.

25. The fixing device according to claim 23, wherein said urging force varying mechanism decreases said urging force when a power is turned off.

26. An image forming apparatus comprising said fixing device according to claim 23, said image forming apparatus further comprising:

an image forming unit that forms a toner image on a recording sheet, said toner image being fixed to said recording sheet by said fixing device; and a control unit that controls said image forming unit and said fixing device.

27. The image forming apparatus according to claim 26, wherein said control unit rotates at least one of said group of rollers to move said endless belt, and heats said second roller and said roller having said heat source among said group of rollers, when said first roller is shifted away from said second roller by said shifting mechanism.

28. The image forming apparatus according to claim 27, further comprising a detection unit that detects said recording sheet, wherein said control unit drives said shifting mechanism according to a detection signal from said detection unit.

29. A fixing device comprising:

a group of rollers including at least one roller having a heat source, said group of rollers further including a first roller having no heat source;

an endless belt stretched around said group of rollers;

a second roller facing said first roller via said endless belt so as to form a nip portion between said second roller and said endless belt;

a tension applying mechanism that applies a tension to said endless belt; and a shifting mechanism that shifts said first roller in the direction away from said second roller, said shifting mechanism shifting said first roller in a direction in which said tension applied to said endless belt decreases, said tension applying mechanism applying said tension to said endless belt in such a range that an impression is not formed on said endless belt and that said endless belt does not slip over said group of rollers, when said first roller is shifted in the direction away from said second roller by said shifting mechanism.

30. A fixing device comprising:

a group of rollers including at least one roller having a heat source, said group of rollers further including a first roller having no heat source;

an endless belt stretched around said group of rollers;

a second roller facing said first roller via said endless belt so as to form a nip portion between said second roller and said endless belt;

a tension applying mechanism that applies a tension to said endless belt; a shifting mechanism that shifts said first roller in the direction away from said second roller; and a release mechanism that releases said tension applied to said endless belt by said tension applying mechanism, when said first roller is shifted in the direction away from said second roller by said shifting mechanism.

31. A fixing device comprising:

a group of rollers including at least one roller having a heat source, said group of rollers further including a first roller having no heat source;

an endless belt stretched around said group of rollers;

a second roller facing said first roller via said endless belt so as to form a nip portion between said second roller and said endless belt;

a shifting mechanism that shifts said first roller in the direction away from said second roller;

an urging mechanism that urges said first roller in a direction toward said second roller via said endless belt; and an urging force varying mechanism that varies an urging force with which said urging mechanism urges said first roller.

* * * * *